US011202484B2

(12) United States Patent
Beers et al.

(10) Patent No.: US 11,202,484 B2
(45) Date of Patent: Dec. 21, 2021

(54) STANDOFF UNIT FOR A CONTROL DEVICE IN AN ARTICLE OF FOOTWEAR

(71) Applicant: NIKE, Inc., Beaverton, OR (US)

(72) Inventors: Tiffany A. Beers, Portland, OR (US); Andrew A. Owings, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 516 days.

(21) Appl. No.: 15/070,162

(22) Filed: Mar. 15, 2016

(65) Prior Publication Data

US 2017/0265561 A1 Sep. 21, 2017

(51) Int. Cl.

| | |
|---|---|
| ***A43C 1/00*** | (2006.01) |
| ***A43C 11/00*** | (2006.01) |
| ***A43B 3/00*** | (2006.01) |
| ***A43C 11/16*** | (2006.01) |

(52) U.S. Cl.

CPC ..... *A43B 3/0005* (2013.01); *A43C 1/00* (2013.01); *A43C 11/008* (2013.01); *A43C 11/165* (2013.01)

(58) Field of Classification Search

CPC ..... A43B 3/005; A43C 11/008; A43C 11/165; A43C 11/00

See application file for complete search history.

(56) References Cited

U.S. PATENT DOCUMENTS 1,678,265 A * 7/1928 Myers ..... 24/113 MP
4,343,975 A * 8/1982 Sado ..... H01H 13/83 200/310
4,356,367 A * 10/1982 Moldenhauer ..... H01H 9/0214 200/243
4,570,039 A * 2/1986 Osawa ..... H01H 13/702 200/5 A
5,836,899 A * 11/1998 Reilly ..... A43B 7/00 601/46
5,860,727 A * 1/1999 Chien ..... A43B 3/0005 362/84
6,956,561 B2 * 10/2005 Han ..... H01H 13/702 178/18.11
7,591,050 B2 9/2009 Hammerslag
(Continued)

FOREIGN PATENT DOCUMENTS

CN 102014682 4/2011
CN 202049879 11/2011
(Continued)

OTHER PUBLICATIONS

"International Application Serial No. PCT/US2017/022289, International Search Report dated Jun. 16, 2017", 3 pgs.
(Continued)

*Primary Examiner* — Katharine G Kane
(74) *Attorney, Agent, or Firm* — Schwegman Lundberg & Woessner, P.A.

(57) ABSTRACT

An article of footwear or an article of apparel can include provisions for facilitating the installation of a control device. The control device can include a panel comprising a plurality of buttons that can provide manual control to a user. The control device can be installed in a compartment within the article after initial manufacture of the article of footwear. In some cases, the control device can include a raised standoff assembly that can be configured to decrease inadvertent pressure being applied to the buttons.

12 Claims, 12 Drawing Sheets

(56) References Cited

U.S. PATENT DOCUMENTS

| | | | | |
|---|---|---|---|---|
| 7,724,132 | B1 * | 5/2010 | Daniel | A43B 3/00 340/539.11 |
| 7,752,774 | B2 | 7/2010 | Ussher | |
| 7,753,547 | B2 | 7/2010 | Waters | |
| 7,924,152 | B1 * | 4/2011 | Daniel | G08B 25/016 340/539.13 |
| 8,046,937 | B2 | 11/2011 | Beers et al. | |
| 9,093,328 | B2 * | 7/2015 | Yamazaki | H01L 27/1225 |
| D751,707 | S * | 3/2016 | Baron | A61B 18/08 D24/144 |
| 9,781,200 | B2 * | 10/2017 | Haslacher | A43B 3/0005 |
| 2004/0130528 | A1 * | 7/2004 | Baker | G06F 3/0338 345/161 |
| 2005/0026410 | A1 * | 2/2005 | Yamazaki | G02F 1/136227 438/597 |
| 2005/0184878 | A1 * | 8/2005 | Grold | A43B 3/0005 340/573.7 |
| 2006/0235377 | A1 * | 10/2006 | Earley | A61B 18/148 606/41 |
| 2006/0276737 | A1 | 12/2006 | Rose | |
| 2007/0157488 | A1 * | 7/2007 | Guzman | A43B 3/0005 36/132 |
| 2009/0026057 | A1 * | 1/2009 | Yoshihiro | H01H 13/85 200/521 |
| 2009/0218207 | A1 * | 9/2009 | Mou | H01H 13/52 200/334 |
| 2010/0013775 | A1 * | 1/2010 | Son | G06F 3/0414 345/168 |
| 2010/0093437 | A1 * | 4/2010 | Hautoplund | A63B 69/0053 463/37 |
| 2011/0094127 | A1 | 4/2011 | Dana, III | |
| 2012/0123664 | A1 * | 5/2012 | Wertz | F02D 29/06 701/110 |
| 2013/0104429 | A1 * | 5/2013 | Torres | A43B 3/0005 36/136 |
| 2013/0312293 | A1 * | 11/2013 | Gerber | A43B 23/17 36/34 R |
| 2014/0062683 | A1 * | 3/2014 | Liu | G06F 3/016 340/407.2 |
| 2014/0196317 | A1 * | 7/2014 | Katz | A43B 7/20 36/89 |
| 2015/0237126 | A1 * | 8/2015 | Haslacher | G01C 22/006 340/573.1 |
| 2015/0289595 | A1 | 10/2015 | Rushbrook et al. | |
| 2015/0289596 | A1 | 10/2015 | Beers et al. | |
| 2015/0334481 | A1 * | 11/2015 | Amae | H04R 1/02 381/386 |

FOREIGN PATENT DOCUMENTS

| | | | |
|---|---|---|---|
| CN | 103584380 | A | 2/2014 |
| CN | 109152449 | A | 1/2019 |
| KR | 1020140120789 | A | 10/2014 |
| WO | WO-2014036371 | A1 | 3/2014 |
| WO | WO-2017160827 | A2 | 9/2017 |
| WO | WO-2017160827 | A3 | 7/2018 |

OTHER PUBLICATIONS

"International Application Serial No. PCT/US2017/022289, Written Opinion dated Jun. 16, 2017", 10 pgs.

"International Application Serial No. PCT/US2017/022289, International Preliminary Report on Patentability dated Sep. 27, 2018", 12 pgs.

"European Application Serial No. 17767328.2, Response filed Apr. 29, 2019 to Communication Pursuant to Rules 161 and 162 dated Nov. 2, 2018", 13 pgs.

"European Application Serial No. 17767328.2, Extended European Search Report dated Oct. 15, 2019", 8 pgs.

"European Application Serial No. 17767328.2, Response May 14, 2020 to Extended European Search Report dated Oct. 15, 2019", 89 pgs.

"Chinese Application Serial No. 201780029910.4, Office Action dated Jun. 28, 2020", w English translation, 30 pgs.

"Chinese Application Serial No. 201780029910.4, Response filed Jan. 13, 2021 to Office Action dated Jun. 28, 2020", w/ Current English claims, 8 pgs.

"Chinese Application Serial No. 201780029910.4, Response filed Jul. 21, 2021 to Office Action dated May 21, 2021".

* cited by examiner

STANDOFF UNIT FOR A CONTROL DEVICE IN AN ARTICLE OF FOOTWEAR

BACKGROUND

The present embodiments relate generally to articles of footwear and methods of manufacturing an article of footwear.

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper. Likewise, some articles of apparel may include various kinds of closure systems for adjusting the fit of the apparel.

SUMMARY

In one aspect, the present disclosure is directed to an article of footwear, the article of footwear comprising an upper and a sole attached to the upper, the upper forming an interior void, and a control device including a button module. The button module comprises a circuit board and a raised standoff assembly, and the circuit board including a panel portion. A first button is mounted on the panel portion of the circuit board and a second button is also mounted on the panel portion of the circuit board. The raised standoff assembly is secured on the panel portion of the circuit board, and the raised standoff assembly comprises a first standoff portion and a second standoff portion, where the first standoff portion is joined to the second standoff portion by an intermediate standoff portion. The first standoff portion includes a first annular ridge that surrounds the first button, and the second standoff portion includes a second annular ridge that surrounds the second button. In addition, the first annular ridge has a first ridge height that is at least as high as a first button height of the first button, and the button module is disposed adjacent to an inner surface of the upper within the interior void of the article of footwear.

In another aspect, the present disclosure is directed to an article of footwear with a control system, the article of footwear comprising an upper and a sole structure, the upper including an outer layer that forms an interior void, and a button module, the button module comprising a circuit board. The circuit board includes a panel portion, and the button module comprises a first portion and a second portion, where the first portion is joined to the second portion by a bridge portion. Furthermore, the button module is disposed under the outer layer of the upper, and a first button is mounted on the panel portion of the circuit board and a second button is also mounted on the panel portion of the circuit board. In addition, a raised standoff assembly is secured to the panel portion of the circuit board, the raised standoff assembly comprising a first standoff portion and a second standoff portion, where the first standoff portion is joined to the second standoff portion by an intermediate standoff portion. The first standoff portion includes a first annular ridge that surrounds the first button, the second standoff portion includes a second annular ridge that surrounds the second button, and the bridge portion has a bridge width that is less than a first width of the first portion. Furthermore, the bridge portion permits the first portion to move relative to the second portion.

In another aspect, the present disclosure is directed to a method of assembling an article of footwear that includes a control device, the control device having a raised standoff assembly and a circuit board, the circuit board including a panel portion, and the panel portion including a first button and a second button. The method comprises the steps of aligning a first standoff portion of the raised standoff assembly with the first button of the panel portion and aligning a second standoff portion of the raised standoff assembly with the second button of the panel portion, stretching an outer border of the raised standoff assembly to surround and capture an outer edge of the panel portion, thereby mounting the raised standoff assembly on the panel portion of the circuit board, and circumferentially surrounding the first button with a first annular ridge of the first standoff portion and circumferentially surrounding the second button with a second annular ridge of the second standoff portion, the first button and the first annular ridge having a substantially similar height. The method further comprises securing the control device to a portion of an upper of the article of footwear, and arranging an outer layer of the upper across an uppermost surface of the first annular ridge such that the outer layer extends over the first button, thereby inhibiting the outer layer of the upper from exerting pressure against the first button.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
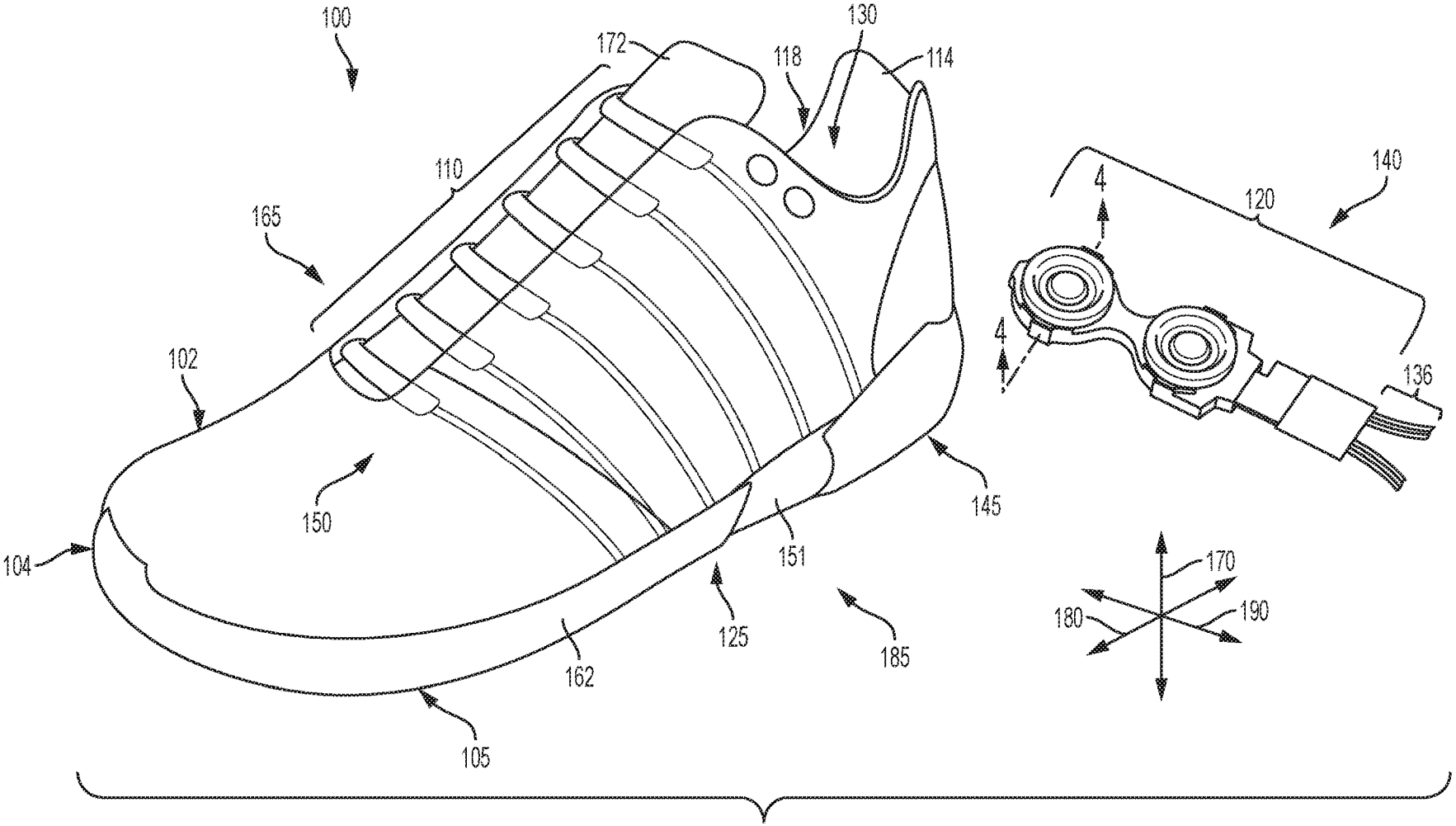
FIG. 1 is an isometric side view of an embodiment of an article of footwear and a control device.

The following discussion and accompanying figures disclose articles of footwear and a method of assembly of an article of footwear. Concepts associated with the footwear disclosed herein may be applied to a variety of athletic footwear types, including running shoes, basketball shoes, soccer shoes, baseball shoes, football shoes, and golf shoes, for example. Accordingly, the concepts disclosed herein apply to a wide variety of footwear types.

To assist and clarify the subsequent description of various embodiments, various terms are defined herein. Unless otherwise indicated, the following definitions apply throughout this specification (including the claims). For consistency and convenience, directional adjectives are employed throughout this detailed description corresponding to the illustrated embodiments.

The term "longitudinal," as used throughout this detailed description and in the claims, refers to a direction extending a length of a component. For example, a longitudinal direction of an article of footwear extends between a forefoot region and a heel region of the article of footwear. The term "forward" is used to refer to the general direction in which the toes of a foot point, and the term "rearward" is used to refer to the opposite direction, i.e., the direction in which the heel of the foot is facing.

The term "lateral direction," as used throughout this detailed description and in the claims, refers to a side-to-side direction extending a width of a component. In other words, the lateral direction may extend between a medial side and a lateral side of an article of footwear, with the lateral side of the article of footwear being the surface that faces away from the other foot, and the medial side being the surface that faces toward the other foot.

The term "side," as used in this specification and in the claims, refers to any portion of a component facing generally in a lateral, medial, forward, or rearward direction, as opposed to an upward or downward direction.

The term "vertical," as used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" refers to the vertical direction heading away from a ground surface, while the term "downward" refers to the vertical direction heading toward the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

The "interior" of a shoe refers to space that is occupied by a wearer's foot when the shoe is worn. The "inner side" of a panel or other shoe element refers to the face of that panel or element that is (or will be) oriented toward the shoe interior in a completed shoe. The "outer side" or "exterior" of an element refers to the face of that element that is (or will be) oriented away from the shoe's interior in the completed shoe. In some cases, the inner side of an element may have other elements between that inner side and the interior in the completed shoe. Similarly, an outer side of an element may have other elements between that outer side and the space external to the completed shoe. Further, the terms "inward" and "inwardly" shall refer to the direction toward the interior of the shoe, and the terms "outward" and "outwardly" shall refer to the direction toward the exterior of the shoe.

For purposes of this disclosure, the foregoing directional terms, when used in reference to an article of footwear, shall refer to the article of footwear when sitting in an upright position, with the sole facing groundward, that is, as it would be positioned when worn by a wearer standing on a substantially level surface.

In addition, for purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, or other joining techniques. In addition, two components may be "fixedly attached" by virtue of being integrally formed, for example, in a molding process.

For purposes of this disclosure, the term "removably attached" or "removably inserted" shall refer to the joining of two components or a component and an element in a manner such that the two components are secured together, but may be readily detached from one another. Examples of removable attachment mechanisms may include hook and loop fasteners, friction fit connections, interference fit connections, threaded connectors, cam-locking connectors, compression of one material with another, and other such readily detachable connectors.

Referring to FIG. 1, an isometric side view of an article of footwear ("article") 100 configured with a tensioning system 150 is depicted. In the current embodiment, article 100 is shown in the form of an athletic shoe, such as a running shoe. However, in other embodiments, tensioning system 150 may be used with any other kind of footwear including, but not limited to, hiking boots, soccer shoes, football shoes, sneakers, running shoes, cross-training shoes, rugby shoes, basketball shoes, baseball shoes as well as other kinds of shoes. Moreover, in some embodiments, article 100 may be configured for use with various kinds of non-sports-related footwear, including, but not limited to, slippers, sandals, high-heeled footwear, loafers as well as any other kinds of footwear. As discussed in further detail below, a tensioning system may not be limited to footwear and, in other embodiments, a tensioning system and/or components associated with a tensioning system could be used with various kinds of apparel, including clothing, sportswear, sporting equipment and other kinds of apparel. In still other embodiments, a tensioning system may be used with braces, such as medical braces.

As noted above, for consistency and convenience, directional adjectives are employed throughout this detailed description. Article 100 may be divided into three general regions along a longitudinal axis 180: a forefoot region 105, a midfoot region 125, and a heel region 145. Forefoot region 105 generally includes portions of article 100 corresponding with the toes and the joints connecting the metatarsals with the phalanges. Midfoot region 125 generally includes portions of article 100 corresponding with an arch area of the foot. Heel region 145 generally corresponds with rear portions of the foot, including the calcaneus bone. Forefoot region 105, midfoot region 125, and heel region 145 are not intended to demarcate precise areas of article 100. Rather, forefoot region 105, midfoot region 125, and heel region 145 are intended to represent general relative areas of article 100 to aid in the following discussion. Since various features of article 100 extend beyond one region of article 100, the terms forefoot region 105, midfoot region 125, and heel region 145 apply not only to article 100, but also to the various features of article 100.

Referring to FIG. 1, for reference purposes, a lateral axis 190 of article 100, and any components related to article 100, may extend between a medial side 165 and a lateral side 185 of the foot. Additionally, in some embodiments, longitudinal axis 180 may extend from forefoot region 105 to a heel region 145. It will be understood that each of these directional adjectives may also be applied to individual components of an article of footwear, such as an upper and/or a sole member. In addition, a vertical axis 170 refers to the axis perpendicular to a horizontal surface defined by longitudinal axis 180 and lateral axis 190.

Article 100 may include upper 102 and sole structure 104. Generally, upper 102 may be any type of upper. In particular, upper 102 may have any design, shape, size, and/or color. For example, in embodiments where article 100 is a basketball shoe, upper 102 could be a high-top upper that is shaped to provide high support on an ankle. In embodiments where article 100 is a running shoe, upper 102 could be a low-top upper.

As shown in FIG. 1, upper 102 may include one or more material elements (for example, meshes, textiles, foam, leather, and synthetic leather), which may be joined to define an interior void 118 configured to receive a foot of a wearer. The material elements may be selected and arranged to impart properties such as light weight, durability, air permeability, wear resistance, flexibility, and comfort. Upper 102 may define an opening 130 through which a foot of a wearer may be received into interior void 118.

At least a portion of sole structure 104 may be fixedly attached to upper 102 (for example, with adhesive, stitching, welding, or other suitable techniques) and may have a configuration that extends between upper 102 and the ground. Sole structure 104 may include provisions for attenuating ground reaction forces (that is, cushioning and stabilizing the foot during vertical and horizontal loading). In addition, sole structure 104 may be configured to provide traction, impart stability, and control or limit various foot motions, such as pronation, supination, or other motions.

In some embodiments, sole structure 104 may be configured to provide traction for article 100. In addition to providing traction, sole structure 104 may attenuate ground reaction forces when compressed between the foot and the ground during walking, running, or other ambulatory activities. The configuration of sole structure 104 may vary significantly in different embodiments to include a variety of conventional or non-conventional structures. In some cases, the configuration of sole structure 104 can be configured according to one or more types of ground surfaces on which sole structure 104 may be used.

For example, the disclosed concepts may be applicable to footwear configured for use on any of a variety of surfaces, including indoor surfaces or outdoor surfaces. The configuration of sole structure 104 may vary based on the properties and conditions of the surfaces on which article 100 is anticipated to be used. For example, sole structure 104 may vary depending on whether the surface is hard or soft. In addition, sole structure 104 may be tailored for use in wet or dry conditions.

In some embodiments, sole structure 104 may be configured for a particularly specialized surface or condition. The proposed footwear upper construction may be applicable to any kind of footwear, such as basketball, soccer, football, and other athletic activities. Accordingly, in some embodiments, sole structure 104 may be configured to provide traction and stability on hard indoor surfaces (such as hardwood), soft, natural turf surfaces, or on hard, artificial turf surfaces. In some embodiments, sole structure 104 may be configured for use on multiple different surfaces.

As will be discussed further below, in different embodiments, sole structure 104 may include different components. For example, sole structure 104 may include an outsole, a midsole, a cushioning layer, and/or an insole. In addition, in some cases, sole structure 104 can include one or more cleat members or traction elements that are configured to increase traction with a ground surface.

In some embodiments, sole structure 104 may include multiple components, which may individually or collectively provide article 100 with a number of attributes, such as support, rigidity, flexibility, stability, cushioning, comfort, reduced weight, or other attributes. In some embodiments, sole structure 104 may include an insole/sockliner, a midsole 151, and a ground-contacting outer sole member ("outsole") 162, which may have an exposed ground-contacting lower surface. In some cases, however, one or more of these components may be omitted. Furthermore, in some embodiments, an insole may be disposed in the void defined by upper 102. The insole may extend through each of forefoot region 105, midfoot region 125, and heel region 145, and between lateral side 185 and medial side 165 of article 100. The insole may be formed of a deformable (for example, compressible) material, such as polyurethane foams, or other polymer foam materials. Accordingly, the insole may, by virtue of its compressibility, provide cushioning, and may also conform to the foot in order to provide comfort, support, and stability.

Midsole 151 may be fixedly attached to a lower area of upper 102, for example, through stitching, adhesive bonding, thermal bonding (such as welding), or other techniques, or may be integral with upper 102. Midsole 151 may be formed from any suitable material having the properties described above, according to the activity for which article 100 is intended. In some embodiments, midsole 151 may include a foamed polymer material, such as polyurethane (PU), ethyl vinyl acetate (EVA), or any other suitable material that operates to attenuate ground reaction forces as sole structure 104 contacts the ground during walking, running, or other ambulatory activities.

Midsole 151 may extend through each of forefoot region 105, midfoot region 125, and heel region 145, and between lateral side 185 and medial side 165 of article 100. In some embodiments, portions of midsole 151 may be exposed around the periphery of article 100, as shown in FIG. 1. In other embodiments, midsole 151 may be completely covered by other elements, such as material layers from upper 102. For example, in some embodiments, midsole 151 and/or other portions of upper 102 may be disposed adjacent to a bootie 114 disposed inside of interior void 118 of article 100. However, other embodiments may not include a bootie.

Furthermore, as shown in FIG. 1, article 100 may include a tongue 172 in some embodiments, which may be provided near or along a throat opening. In some embodiments, tongue 172 may be provided in or near an instep region 110 of article 100. However, in other embodiments, tongue 172 may be disposed along other portions of an article of footwear, or an article may not include a tongue.

In addition, as noted above, in different embodiments, article 100 may include tensioning system 150. Tensioning system 150 may comprise various components and systems for adjusting the size of an opening 130 leading to interior void 118 and tightening (or loosening) upper 102 around a wearer's foot. Some examples of different tensioning systems that can be used are disclosed in Beers et al., U.S. Patent Publication Number 2014/0070042 published Mar. 13, 2014, (previously U.S. patent application Ser. No. 14/014,555, filed Aug. 30, 2013) and entitled "Motorized Tensioning System with Sensors" and Beers et al., U.S. Pat. No. 8,056,269, issued Nov. 15, 2011 (previously U.S. Patent Publication Number 2009/0272013, published Nov. 5, 2009) and entitled "Article of Footwear with Lighting System," the disclosures of which are incorporated herein by reference in their entirety.

Furthermore, the embodiments described herein may also include or refer to techniques, concepts, features, elements, methods, and/or components from U.S. Patent Publication Number 2016/0345679 A1, published Dec. 1, 2016, (previously U.S. patent application Ser. No. 14/723,972, filed May 28, 2015), titled "An Article Of Footwear And A Method Of Assembly Of The Article Of Footwear,", U.S. Patent Publication Number 2016-0345653 A1, published Dec. 1, 2016, (previously U.S. patent application Ser. No. 14/723,832, filed May 28, 2015), titled "A Lockout Feature For A Control Device,", U.S. Patent Publication Number 2016-0345654 A1, published Dec. 1, 2016, (previously U.S. patent application Ser. No. 14/723,880, filed May 28, 2015), titled "A Charging System for an Article of Footwear,", U.S. Patent Publication Number 2016-0345671 A1, published Dec. 1, 2016, (previously U.S. patent application Ser. No. 14/723,994, filed May 28, 2015), titled "A Sole Plate for an Article of Footwear,", U.S. Patent Publication Number 2016-0345655 A1, published Dec. 1, 2016, (previously U.S. patent application Ser. No. 14/724,007, filed May 28, 2015), titled "A Control Device for an Article of Footwear,", and U.S. Patent Publication Number 2016-0345681 A1, published Dec. 1, 2016, (previously U.S. patent application Ser. No. 14/955,705, filed Dec. 1, 2015), titled "An Automated Tensioning System For An Article Of Footwear," the entirety of each application being herein incorporated by reference.

In some embodiments, tensioning system 150 may comprise one or more laces, as well as a motorized tensioning device. A lace as used with article 100 may comprise any type of lacing material known in the art. Examples of laces that may be used include cables or fibers having a low modulus of elasticity as well as a high tensile strength. A lace may comprise a single strand of material, or can comprise multiple strands of material. An exemplary material for the lace is SPECTRA™, manufactured by Honeywell of Morris Township N.J., although other kinds of extended chain, high modulus polyethylene fiber materials can also be used as a lace. The arrangement of the lacing depicted in the figures is only intended to be exemplary and it will be understood that other embodiments are not limited to a particular configuration for lacing elements.

Some embodiments may include one or more compartments, recesses, channels, or other receiving portions that are disposed throughout various portions of article 100. For purposes of this disclosure, a compartment refers to a separate or distinct section or portion of article 100. In some embodiments, a compartment can include a sleeve-like region, a tunnel or tubing disposed within article 100, and/or a recess, cavity, pocket, chamber, slot, pouch, or other space configured to receive an object, element, or component. In some embodiments, during manufacture of article 100, one or more compartments can be included in article 100. For example, as will be discussed further below with respect to FIG. 9, article 100 can include a sleeve or elastic band disposed along an underside of upper 102. In some embodiments, the elastic band can receive or securely hold a component.

As noted above, in different embodiments, article 100 may include other elements. Referring to FIG. 1, article 100 includes bootie 114 that is disposed within upper 102. Bootie 114 may be removed, separated, or detached from article 100 in some embodiments. In one embodiment, the position or arrangement of bootie 114 may be adjusted within article 100. In some embodiments, bootie 114 or other elements may be moved (or removed) and then reinserted or replaced into article 100 (i.e., returned to their original arrangement within article 100) in different embodiments. This can occur after manufacture of article 100, as discussed further below. Bootie 114 and/or other such adjustable inner lining materials or elements (such as a tongue) associated with the disclosed embodiments of article 100 may be referred to as "removable elements" for purposes of this description and the claims.

In one embodiment, bootie 114 can substantially surround or bound an interior void 118 in article 100 and can be removed for insertion of components into article 100. For example, bootie 114 can be pulled or removed from interior void 118 of upper 102. It should be understood that in other embodiments, article 100 may not include bootie 114, or the configuration of bootie 114 may differ from that illustrated herein. In some embodiments, the removal of bootie 114 may expose or facilitate access regions within article 100 to one or more compartments. In one embodiment, the displacement of bootie 114 and/or other removable elements (for example, a tongue) can expose different areas within interior void 118.

Furthermore, it should be understood that the embodiments described herein with respect to the compartments in FIG. 1, and in further figures, may be applicable to articles that do not include a tensioning system. In other words, the method of manufacture where an article can include compartments, and/or the article which includes such compartments, may be utilized in any type or configuration of footwear or article of apparel.

As noted above, some embodiments of article 100 may utilize various kinds of devices for sending or transmitting commands to a motorized tensioning or lacing system or other mechanisms. In different embodiments, an article may include provisions for managing, commanding, directing, activating, or otherwise regulating the functions of other devices or systems. For example, various articles may utilize different kinds of devices for sending commands to systems associated with the article. In some embodiments, an article can include a control device 140. One embodiment of control device 140 is shown adjacent to article 100 in FIG. 1.

In some embodiments, a control device may include various buttons, switches, mechanisms, or components that can be utilized for relaying instructions or commands to a system in article 100. For example, a control device can include elements for measuring current, pressure, or other properties in article 100. In different embodiments, the control device may include components or elements that can detect and measure a relative change in a force or applied load, detect and measure the rate of change in force, identify force thresholds, and/or detect contact and/or touch. In FIG. 1, it can be seen that control device 140 comprises a button module portion ("button module") 120 joined to a wiring portion 136. It should be understood that the embodiments described herein with respect to control device 140 may be applicable for use with articles that do not include a tensioning system. In other words, control device 140 may be utilized in any type or configuration of footwear or article of apparel.

Figure 2:
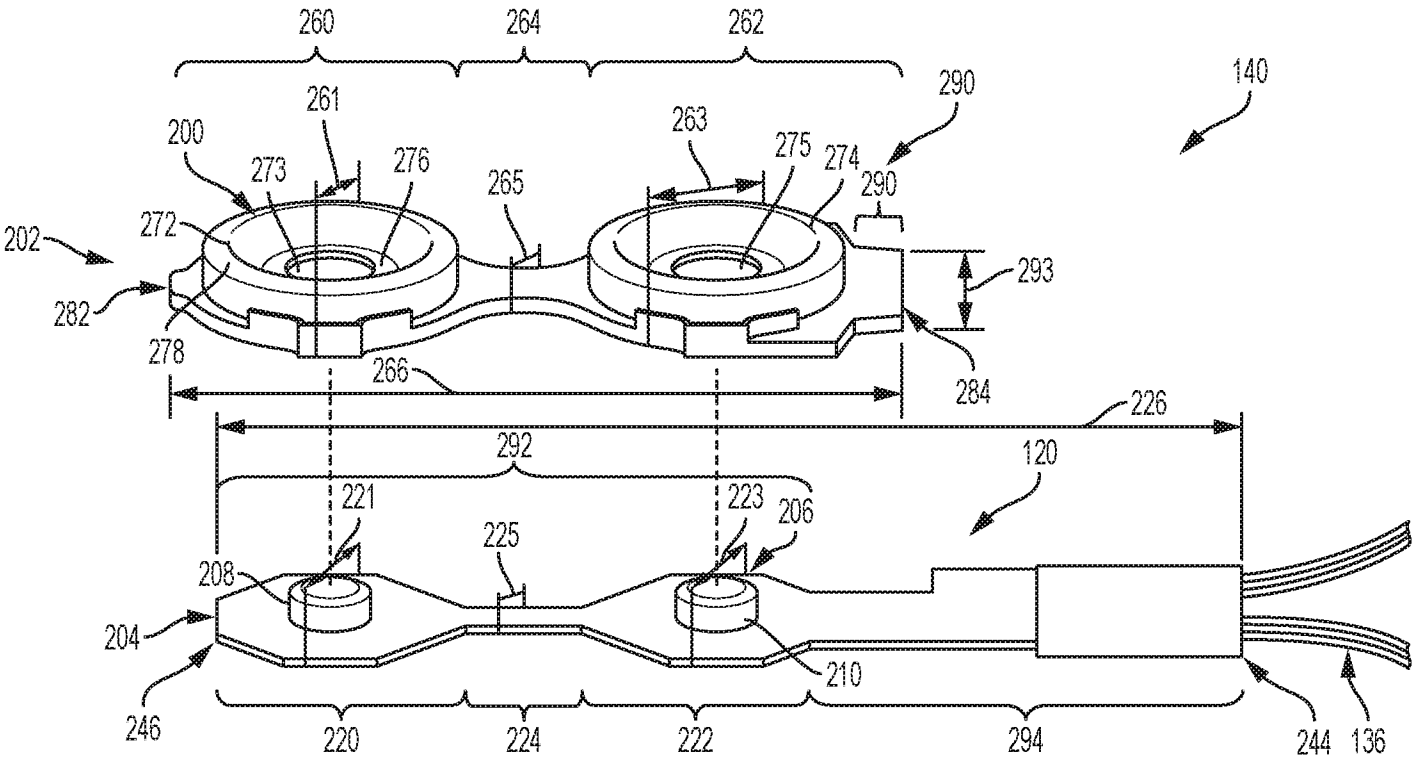
FIG. 2 is an exploded view of an embodiment of a control device.

Referring now to the exploded view of control device 140 depicted in FIG. 2, it can be seen that button module 120 can comprise a raised standoff assembly ("standoff assembly") 202 that is secured to a circuit board 204. Furthermore, in some embodiments, control device 140 may include one or more buttons 206 disposed along a panel portion 292 of circuit board 204. Buttons 206 could be used for manually inputting or entering commands to any type of system or other mechanism. As described above with respect to the motorized tensioning system, in some embodiments, buttons 206 could be used in initiating incremental tightening and incremental loosening commands, for example. In other embodiments, additional buttons can be included for initiating any other commands including an open command (or fully loosen command), store tension command, and return to stored tension command. Still other embodiments could incorporate any other buttons for issuing any other kinds of commands. In different embodiments, buttons for tightening laces, loosening laces, and/or performing other functions can be located directly on or in an article. For purposes of this disclosure, buttons refer to a material or element that can be pressed or otherwise handled to operate a mechanism, such as a button, switch, knob, control, lever, handle, or other such control means.

Furthermore, in different embodiments, buttons 206 can be mechanically configured such that a bottom side of each button has a female mating portion that grasps and engages with a corresponding male mechanical connector disposed on circuit board 204. In some embodiments, the inner surface of a button can include an actuating projection designed to press the piezo-electric or solenoid button located within circuit board 204. In other embodiments, buttons 206 can incorporate or utilize any other means of generating a signal known in the art.

Control device 140 may also include provisions for connecting circuit board 204 to other elements. For example, as noted earlier, there may be wiring portion 136 that is attached to circuit board 204 and extends in a direction away from circuit board 204. Wiring portion 136 may be varying lengths in different embodiments, and may be adjusted depending on the compartment and/or article that control device 140 will be installed in. Some embodiments of wiring portion 136 can include features or components described in U.S. Patent Publication Number 2017-0365571 A1, published Sep. 21, 2017, (previously U.S. patent application Ser. No. 15/070,395, filed Mar. 15, 2016), titled "A Wiring Harness For An Article of Manufacture", the entirety of the application being herein incorporated by reference.

Furthermore, in some embodiments, circuit board 204, standoff assembly 202, and other components of control device 140 may comprise various material compositions. In some embodiments, circuit board 204 can be associated with a higher stiffness or hardness than standoff assembly 202. In one embodiment, portions of control device 140 including buttons 206 and circuit board 204 can be at least partially formed of a plastic or metal material, a polymer, and/or a polymeric material. The materials used in the manufacture of control device 140 may be selected based on providing the component with improved electrical or insulation properties, flexibility, resilience, weight, durability, and/or energy efficiency. In some embodiments, portions of standoff assembly 202 can comprise a rubber, elastic, plastic, polymer, or an otherwise elastically deformable material.

In some embodiments, circuit board 204 may comprise a substantially flat panel or two-dimensional material or structure. The term "two-dimensional" as used throughout this detailed description and in the claims refers to any generally flat material exhibiting a length and width that are substantially greater than a thickness of the material. Although two-dimensional materials may have smooth or generally untextured surfaces, some two-dimensional materials will exhibit textures or other surface characteristics, such as dimpling, protrusions, ribs, or various patterns, for example. In other embodiments, the geometry of circuit board 204 could vary and could include various contours or features associated with parts of a foot, for example, the instep region of a foot.

In addition, for purposes of reference, circuit board 204 can include different portions. In the embodiment of FIG. 2, panel portion 292 of circuit board 204 includes a first board portion 220, a second board portion 222, and an intermediate board portion 224. Intermediate board portion 224 extends between and joins first board portion 220 with second board portion 222. In FIG. 2, a first button 208 is attached to first board portion 220, and a second button 210 is attached to second board portion 222. In addition, panel portion 292 can be joined to a first arm portion 294 that extends outward toward wiring portion 136. First arm portion 294 is substantially flat and may not include any buttons in some embodiments. However, in other embodiments, circuit board 204 may comprise any desired object or element, and/or any number of buttons.

Portions comprising circuit board 204 may have different dimensions and/or shapes in different embodiments. For example, in FIG. 2, buttons 206 are disposed along a substantially continuous strip that comprises circuit board 204. However, in other embodiments, the dimensions and/or shape of circuit board 204 may differ, including, but not limited to oblong, square, oval, elliptical, or other regular or irregular shapes. In addition, first board portion 220 and second board portion 222 can each have substantially similar shapes associated with the horizontal plane. For example, first board portion 220 and/or second board portion 222 may be generally round, rectangular, square, triangular, elliptical, pentagonal, hexagonal, or any other regular or irregular shape. In addition, intermediate board portion 224 can have a generally elongated or rectangular shape in different embodiments.

Furthermore, different portions of circuit board 204 can differ in size. In FIG. 2, it can be seen that circuit board 204 has a first board width 221 (roughly equivalent to a diameter of first board portion 220), a second board width 223 (roughly equivalent to a diameter of second board portion 222), an intermediate board width 225 (associated with a width of intermediate board portion 224), and a board length 226. First board width 221 and second board width 223 can be substantially similar in some embodiments, though in other embodiments, they can differ, such that the surface area of first board portion 220 varies from that of second board portion 222. In addition, in cases where first board portion 220 and second board portion 222 have a generally regular shape, the width or diameter of each portion can be substantially constant. However, in other embodiments, some portions of first board portion 220 and second board portion 222 can be associated with varying widths. In such cases, first board width 221 will be understood to represent the maximum width of first board portion 220, and second board width 223 will be understood to represent the maximum width of second board portion 222.

In addition, board length 226 may be understood to extend from a first board end 246 to a second board end 244 of circuit board 204. In some embodiments, second board end 244 is associated with the region of circuit board 204 that is joined to wiring portion 136, while first board end 246 is associated with a substantially free (unattached) end of circuit board 204.

Buttons 206 may include different shapes and/or sizes in different embodiments. It can be understood that a horizontal cross-sectional area of each of buttons 206 is substantially smaller than a horizontal cross-sectional area of each of first board portion 220 and second board portion 222. Furthermore, buttons 206 may be round, square, triangular, or other regular or irregular shape. In addition, two or more buttons 206 may comprise substantially similar shapes, or each button may be different from another. As an example, first button 208 may be a rounded-shape, while second button 210 may be square-shaped or triangular-shaped.

In addition, for purposes of reference, standoff assembly 202 includes a first standoff portion 260, a second standoff portion 262, and an intermediate standoff portion 264. Intermediate standoff portion 264 extends between and joins first standoff portion 260 with second standoff portion 262.

The various portions comprising standoff assembly 202 may have different dimensions and/or shapes in different embodiments. For example, the dimensions and/or shape of standoff assembly 202 may include, but are not limited to, generally oblong, square, oval, elliptical, or other regular or irregular shapes. In addition, first standoff portion 260 and second standoff portion 262 can each have substantially similar shapes associated with the horizontal plane. For example, first standoff portion 260 and/or second standoff portion 262 may be round, rectangular, square, triangular, elliptical, pentagonal, hexagonal, or any other regular or irregular shape in some embodiments. In addition, intermediate standoff portion 264 can have a generally elongated or rectangular shape in different embodiments.

Furthermore, different portions of standoff assembly 202 can differ in size. In FIG. 2, it can be seen that standoff assembly 202 has a first standoff width 261 (roughly equivalent to a diameter of first standoff portion 260), a second standoff width 263 (roughly equivalent to a diameter of second standoff portion 262), an intermediate standoff width 265 (associated with a width of intermediate standoff portion 264), and a standoff length 266. First standoff width 261 and second standoff width 263 can be substantially similar in some embodiments, though in other embodiments, they can differ, such that the surface area of first standoff portion 260 varies from that of second standoff portion 262. In addition, in cases where first standoff portion 260 and second standoff portion 262 have a generally regular shape, the width or diameter of each portion can be substantially constant. However, in other embodiments, when the standoff portions include some irregular shape for example, some portions of each of first standoff portion 260 and second standoff portion 262 can be associated with varying widths. In such cases, first standoff width 261 will be understood to represent the maximum width of first standoff portion 260, and second standoff width 263 will be understood to represent the maximum width of second standoff portion 262.

In addition, standoff length 266 may be understood to extend from a first standoff end 282 to a second standoff end 284 of standoff assembly 202. In some embodiments, second standoff portion 262 can also include a second arm portion 290. In FIG. 2, second arm portion 290 has an elongated rectangular shape, with an arm width 293 that is smaller than that of second standoff width 263, and greater than that of intermediate standoff width 265. In some embodiments, second arm portion 290 can extend outward (away from first standoff end 282) and comprise a substantially polygonal shape, toward second standoff end 284. Second standoff end 284 can be a substantially straight or linear edge in some embodiments, though in other embodiments, second standoff end 284 may be curved or include other irregularities. In some embodiments, second standoff end 284 can be understood to be associated with the region of standoff assembly 202 that extends away from second standoff portion 262, while first standoff end 282 is associated with a substantially curved or rounded end adjacent to first standoff portion 260, though in other embodiments the shape of first standoff end 282 may differ. Furthermore, second arm portion 290 can extend over at least some of first arm portion 294 when standoff assembly 202 is attached to circuit board 204 in some embodiments.

Figure 3:
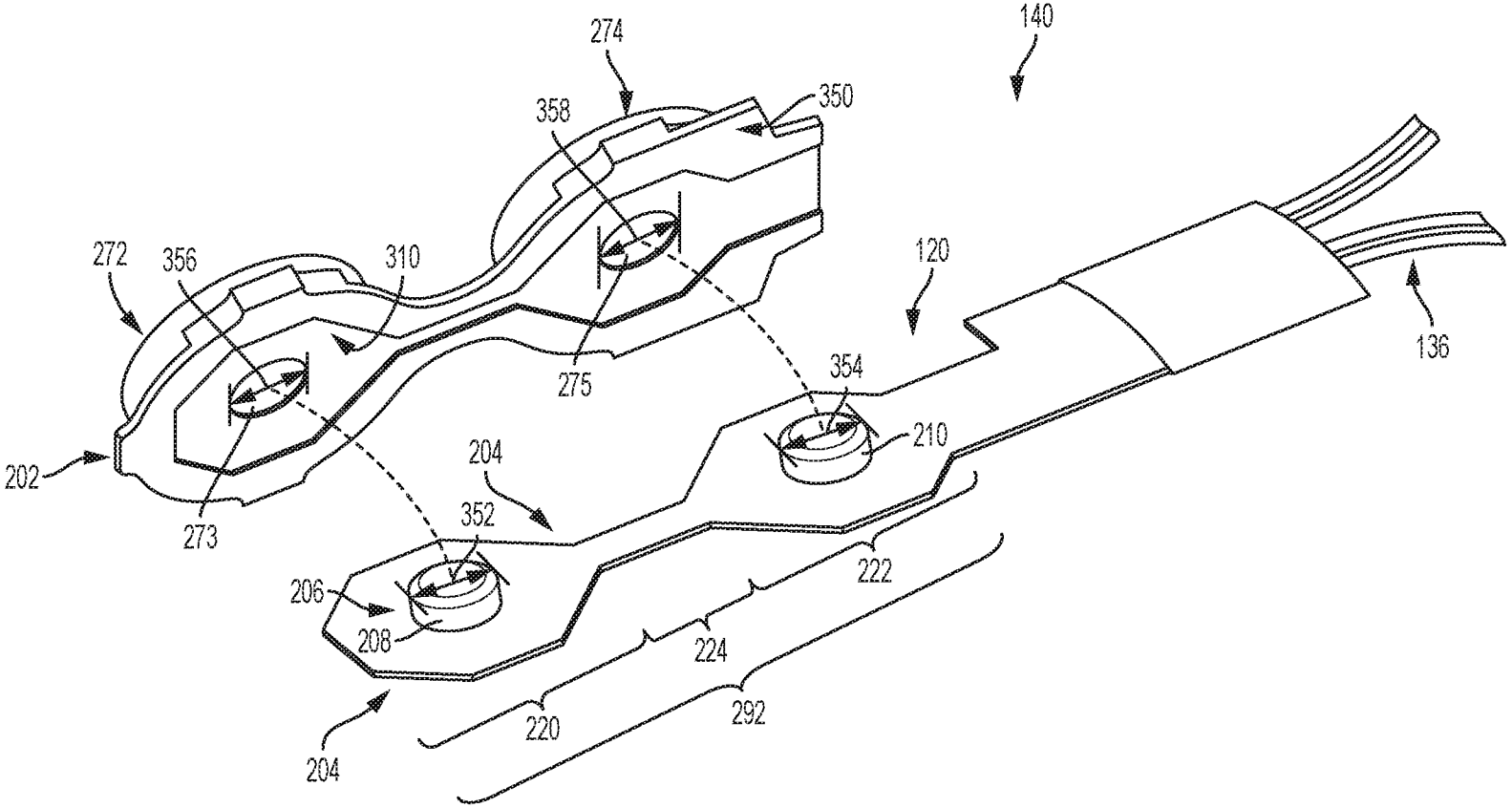
FIG. 3 is an exploded view of an embodiment of a control device.

In different embodiments, standoff assembly 202 can include provisions for surrounding and/or protecting or bordering regions of circuit board 204 or buttons 206. In some embodiments, standoff assembly 202 includes a set of raised annular ridges ("annular ridges") 200. In FIG. 2, a first annular ridge ("first ridge") 272 is formed along first standoff portion 260, and a second annular ridge ("second ridge") 274 is formed along second standoff portion 262. However, in other embodiments, standoff assembly 202 may comprise any desired object or contours, and/or any number of annular ridges 200. Annular ridges 200 may include different shapes and/or sizes in different embodiments. For example, annular ridges 200 may have an inner portion and an outer portion that can differ. The inner portion may be substantially round, while the outer portion may be round, square, triangular, pentagonal, hexagonal, or any other regular or irregular shape. In FIG. 3, first ridge 272 has a substantially round inner portion 276 and a substantially round outer portion 278 (see FIG. 2).

Furthermore, in some embodiments, the annular ridges can include provisions for receiving, circumferentially surrounding and/or encircling buttons 206. In FIG. 2, first ridge 272 includes a first aperture 273 associated with the periphery of inner portion 276, and second ridge 274 includes a second aperture 275 associated with the periphery of the inner portion of second ridge 274.

FIG. 3 also presents an exploded view of control device 140. Furthermore, in FIG. 3, an isometric view of a lower surface 310 of standoff assembly 202 is shown for purposes of clarity. In different embodiments, button module 120 can include provisions for facilitating the assembly of control device 140. It can be seen that in some embodiments, the dimensions of different portions of standoff assembly 202 can align with or correspond to dimensions of different portions of circuit board 204 and buttons 206.

As shown in FIG. 3, each button has a substantially rounded shape. In one embodiment, each of buttons 206 can be associated with a diameter. For example, referring to FIG. 3, first button 208 has a first diameter 352, and second button 210 has a second diameter 354. In some embodiments, first diameter 352 and second diameter 354 may be substantially similar, as shown in FIG. 2, such that buttons 206 are generally uniform in size across circuit board 204. In other embodiments, first diameter 352 and second diameter 354 may differ, such that one button is larger than the other. In some embodiments, buttons may differ in size or shape to provide visual or tactile feedback to a user regarding a particular button. In some cases, buttons 206 may be shaped or dimensioned differently to provide tactile or visual feedback to a user. In other embodiments, there may be a desired design or aesthetic that can be formed as a result of varying button shapes or sizes. Furthermore, each button diameter and/or thickness may be configured to align with other components or portions of an article, as will be discussed further below with respect to FIGS. 4 and 8. In addition, two or more buttons 206 may comprise substantially similar shapes, or each button may be different from another. As an example, first button 208 may be round-shaped, while second button 210 may be square shaped or triangular shaped.

Similarly, as shown in FIGS. 2-3, each annular ridge—in particular referring to apertures formed in the annular ridges—has a substantially rounded shape. In one embodiment, each aperture can be associated with a diameter. For example, referring to FIG. 3, first aperture 273 has a third diameter 356, and second aperture 275 has a fourth diameter 358. In some embodiments, third diameter 356 and fourth diameter 358 may be substantially similar, as shown in FIG. 3, such that the apertures are generally uniform in size across standoff assembly 202. In other embodiments, third diameter 356 and fourth diameter 358 may differ, such that one aperture is larger than the other. In some embodiments, apertures may differ in size or shape to accommodate the shape and/or size of a corresponding button attached to circuit board 204.

In different embodiments, the diameters of each of the apertures can be at least slightly larger than the diameters of each of the corresponding buttons that are received by the apertures. In other words, in one embodiment, first diameter 352 is slightly larger than third diameter 356, and second diameter 354 is slightly larger than fourth diameter 358. This can allow first button 208 to be snugly inserted into the opening provided within first ridge 272, and second button 210 to be snugly inserted into the opening provided within second ridge 274. In other embodiments, however, the difference may be greater, such that first diameter 352 is substantially larger than third diameter 356, and/or second diameter 354 is substantially larger than fourth diameter 358.

Furthermore, standoff assembly 202 can include provisions for engaging and/or being secured to circuit board 204 in different embodiments. In FIG. 3, standoff assembly 202 includes a lip portion 350. Lip portion 350 can extend around the substantial entirety of a lower peripheral (outer) edge of standoff assembly 202 in some embodiments. In some embodiments, lip portion 350 comprises a resilient, thin material extending downward from the main body of standoff assembly 202, such as silicone or another elastic material. In some embodiments, lip portion 350 comprises a material that can be bent or elastically deformed. In the embodiment of FIG. 3, lip portion 350 extends around the entire peripheral edge of first standoff portion 260 and intermediate standoff portion 264, as well as a majority of the peripheral edge of second standoff portion 262. In one embodiment, lip portion 350 extends around all of standoff assembly 202 except for the region associated with second standoff end 284.

Figure 4:
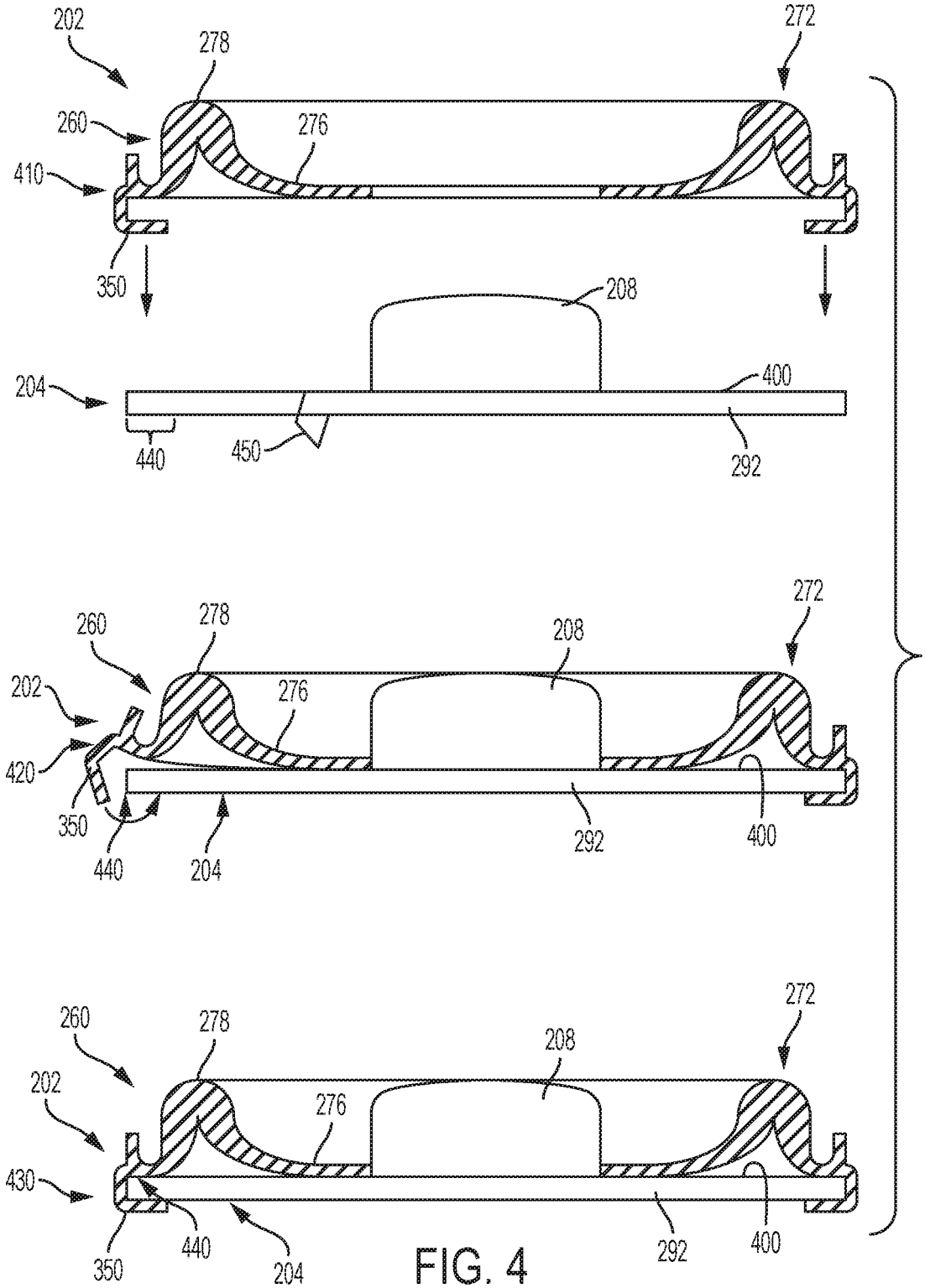
FIG. 4 is a schematic cross-sectional sequence of an embodiment of attaching a raised standoff assembly to a circuit board.

Referring now to FIG. 4, an embodiment of a sequence of steps for securing standoff assembly 202 to circuit board 204 is depicted. It should be understood that the depiction provided in FIG. 4 is for illustrative purposes, and in other embodiments, the process of attaching standoff assembly 202 to circuit board 204 can differ. The cross-sectional views provided in FIG. 4 are along the width of control device 140, and are taken along the lines 4-4 of FIG. 1.

In a first step 410 shown at the top of the figure, a cross-sectional view of standoff assembly 202 is shown above a cross-sectional view of circuit board 204. In this step, each ridge of the raised standoff assembly may be aligned with each button. Standoff assembly 202 can be understood to be in an initial (neutral) or at-rest state, when no external forces are applied to the assembly.

In a second step 420, standoff assembly 202 and circuit board 204 are brought closer together, and as they approach one another, an outer border of the raised standoff assembly comprising lip portion 350 can be stretched and deformed until lip portion 350 surrounds and captures an outer edge 440 of circuit board 204 associated with panel portion 292. During this process, first button 208 can be circumferentially surrounded by first ridge 272 of first standoff portion 260. Similarly, in some embodiments, the second button can also be circumferentially surrounded by the second annular ridge of the second standoff portion (as described above with respect to FIGS. 2 and 3). In a third step 430, standoff assembly 202 can be released, and lip portion 350 substantially returns to its initial state while securely grasping outer edge 440, thereby mounting raised standoff assembly 202 on circuit board 204. In some embodiments, lip portion 350 can be configured to compress outer edge 440 when mounted on circuit board 204.

Furthermore, it can be seen that circuit board 204 includes a board thickness 450. Board thickness 450 may be generally consistent throughout circuit board 204, or may vary. Lip portion 350 can be sized and dimensioned to accommodate the thickness associated with circuit board 204 in some embodiments. In addition, in some embodiments, the area comprising panel portion 292 can be smaller than the area associated with by standoff assembly 202, where standoff assembly 202 is configured to substantially enclose, cover, or wrap around at least an upper surface 400 of circuit board 204.

Figure 5:
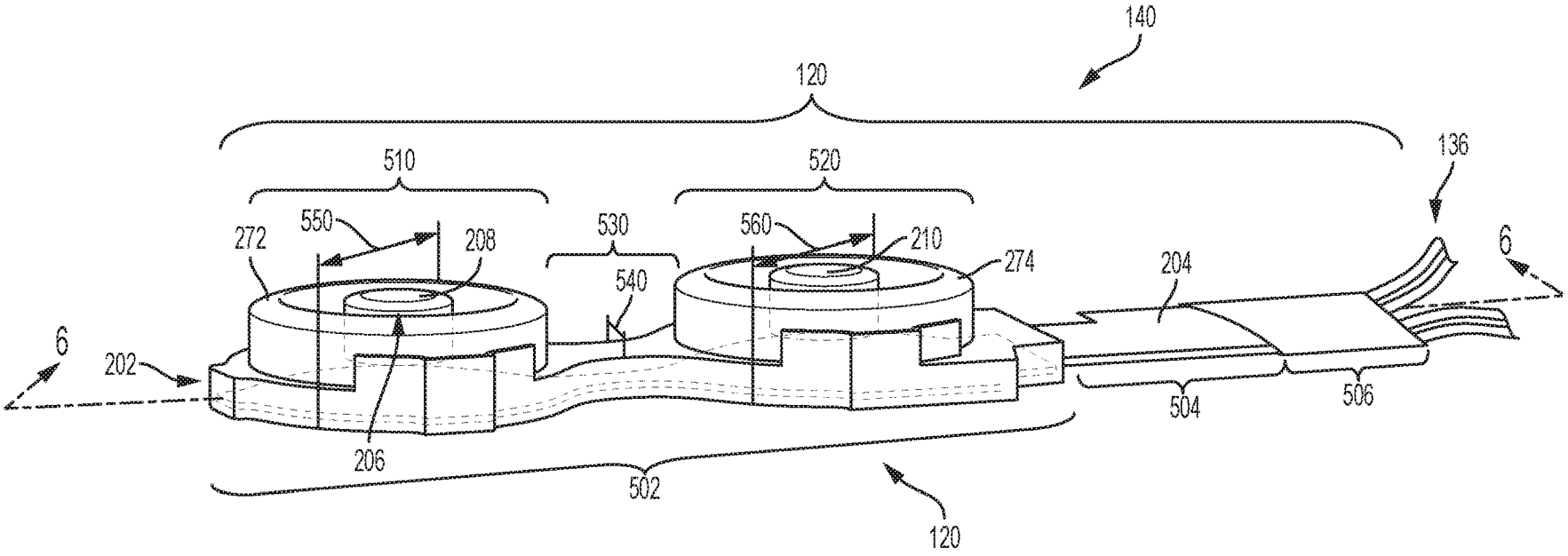
FIG. 5 is an isometric view of an embodiment of a control device.

FIG. 5 presents an embodiment of an assembled control device 140, where control device 140 mainly comprises button module 120 and wiring portion 136. For purposes of reference, circuit board 204 (depicted beneath standoff assembly 202 in dotted line) can be understood to comprise a forward portion 502, a rearward portion 504, and a tail portion 506. Forward portion 502 is associated with the portion of circuit board 204 that is covered by standoff assembly 202, and tail portion 506 is the portion that bonds, joins, or otherwise connects circuit board 204 to wiring portion 136. Rearward portion 504 extends between forward portion 502 and tail portion 506.

In the isometric view of FIG. 5, it can be seen that in one embodiment, each button has a height that extends in a substantially parallel manner to the surrounding annular ridge. In other words, each annular ridge extends around and surrounds a button like a continuous, curved wall. In some embodiments, first ridge 272 can surround first button 208 in a substantially uniform manner, and second ridge 274 can surround second button 210 in a substantially uniform manner.

Furthermore, for purposes of reference, the assembled button module 120 can be understood to comprise a first portion 510 and a second portion 520 joined together by a bridge portion 530. First portion 510 includes both first board portion 220 of circuit board 204 and first standoff portion 260 of standoff assembly 202, as well as first button 208 (see exploded view of FIG. 2). Second portion 520 includes both second board portion 222 of circuit board 204 and second standoff portion 262 of standoff assembly 202, as well as second button 210 (see exploded view of FIG. 2). In addition, bridge portion 530 includes both intermediate board portion 224 of circuit board 204 and intermediate standoff portion 264 of standoff assembly 202 (see exploded view of FIG. 2). In the embodiment shown in FIG. 5, bridge portion 530 has a bridge width 540 that is less than a first width 550 of first portion 510. Similarly, bridge width 540 is less than a second width 560 of second portion 520. In some embodiments, the more narrow width of bridge portion 530 relative to other portions of button module 120 can permit first portion 510 to readily move relative to second portion 520, as will be discussed further below with respect to FIGS. 7 and 8.

Figure 6:
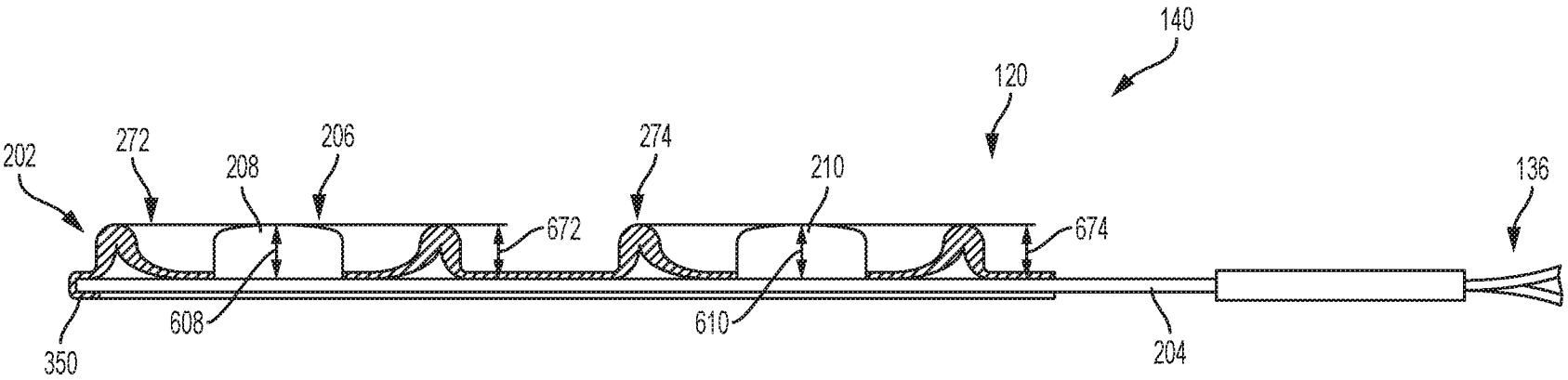
FIG. 6 is a cross-sectional view of an embodiment of a control device.

In different embodiments, button module 120 can include provisions for reducing incidental or unintended depression of buttons 206. In some embodiments, raised standoff assembly 202 can be configured to inhibit an outer layer of the upper of an article of footwear (see FIG. 1) from exerting pressure against a button. Referring now to the cross-sectional view of control device 140 of FIG. 6 (taken along the line 6-6 in FIG. 5), it can be seen that in some embodiments, the heights of various portions of standoff assembly 202 and buttons 206 can be substantially similar. In FIG. 6, first ridge 272 has a first ridge height 672, second ridge 274 has a second ridge height 674, first button 208 has a first button height 608, and second button 210 has a second button height 610. In different embodiments, first button height 608 can be substantially similar to first ridge height 672, and/or second button height 610 can be substantially similar to second ridge height 674. However, it should be understood that in other embodiments, first button height 608 can be slightly smaller or substantially smaller than first ridge height 672, and/or second button height 610 can be slightly smaller or substantially smaller to second ridge height 674. It should be understood that the heights of first button 208 and second button 210 may change or decrease when a button is depressed, and the identification of first button height 608 and second button height 610 refers to the maximum height of each button (i.e., when the buttons are in a neutral, unpressed state). Furthermore, in different embodiments, first button 208 and second button 210 may each comprise varying button thicknesses or heights with respect to one another.

Thus, in some embodiments, first ridge 272 has first ridge height 672 that is at least as high as first button height 608 of first button 208. Similarly, in some embodiments, second ridge 274 has second ridge height 674 that is at least as high as second button height 610 of second button 210. By ensuring that the maximum height of each button associated with a top surface of the button is aligned with (i.e., has a similar height) or is less than the height of the corresponding annular ridge, the chance of inadvertent contact or pressure being exerted on the buttons is decreased. In some embodiments, the raised standoff assembly 202 can thus decrease the possibility of inadvertent activation of systems that are connected to button module 120, as will be discussed further with respect to FIGS. 10-13.

Figure 7:
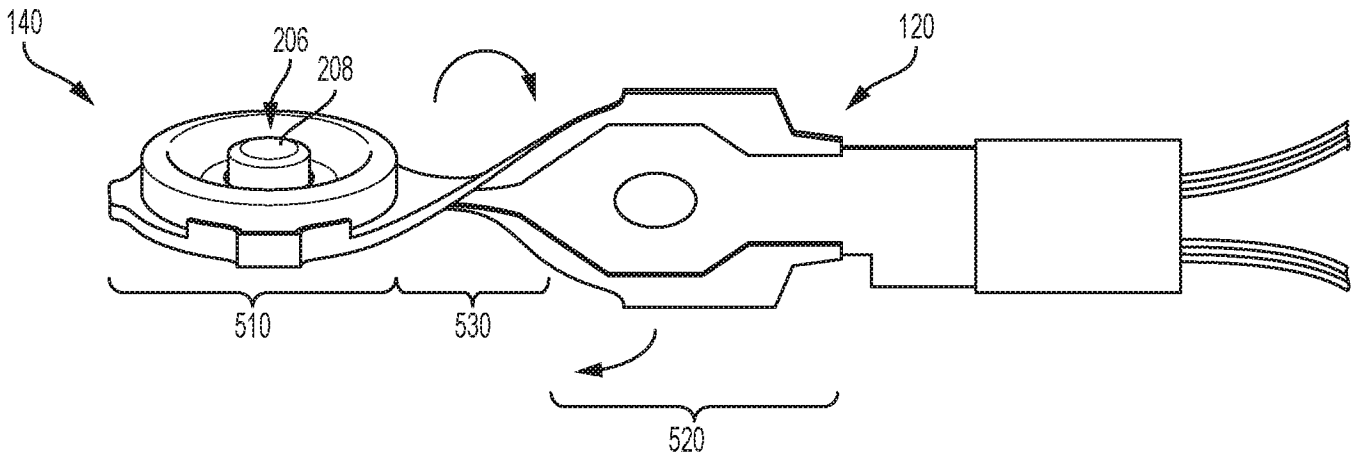
FIG. 7 is a schematic isometric view of an embodiment of a control device being twisted.

In different embodiments, control device 140 can include provisions for durability and use in an article of footwear. For example, in FIGS. 7 and 8, it can be seen that the structure of button module 120 can provide additional benefits during the use of control device 140. As noted above, in some embodiments, the more narrow width of bridge portion 530 can permit first portion 510 to move relative to second portion 520. In one embodiment, button module 120 can have a substantially "hourglass" or "figure-eight" shape. In other words, in some embodiments, first portion 510 and second portion 520 can be similar to loop-shaped portions that are joined by a relatively narrow or elongated material comprising bridge portion 530. Referring to FIG. 7, in one embodiment, button module 120 can be configured to permit buttons 206 to move or twist relative to one another. In some embodiments, first portion 510 can be attached to second portion 520 by bridge portion 530 in a substantially symmetrical fashion. When a torsional force is applied to either or both of first portion 510 or second portion 520, the longitudinal axis of each of the portions can rotate or (torsionally) twist such that they become disposed in perpendicular relation with one another within the same plane in some cases.

In different embodiments, because of the structure of narrow bridge portion 530, which acts as a kind of narrow "waist" region, any electrical components, connections, or wiring between first portion 510 and second portion 520 can remain secure and, in some embodiments, substantially stationary. Because first portion 510 and second portion 520 are joined together by a narrow waist (bridge portion 530), the two portions can "float" relative to one another and—in response to different forces—each button has the ability to twist or bend with respect to one another (torsional twist). The particular shape of button module 120 can thus provide torsion resistance to the wiring extending between the two portions because while first portion 510 and second portion 520 (comprising first button 208 and second button 210, as shown in FIG. 5) can torsion in opposite directions, the connecting wires between them remain stable, experiencing only a minimal amount of the bending forces. Furthermore, the materials comprising button module 120 are resilient enough to sustain repeated deformation and also permit the return of button module 120 to its original, generally flat configuration.

Figure 8:
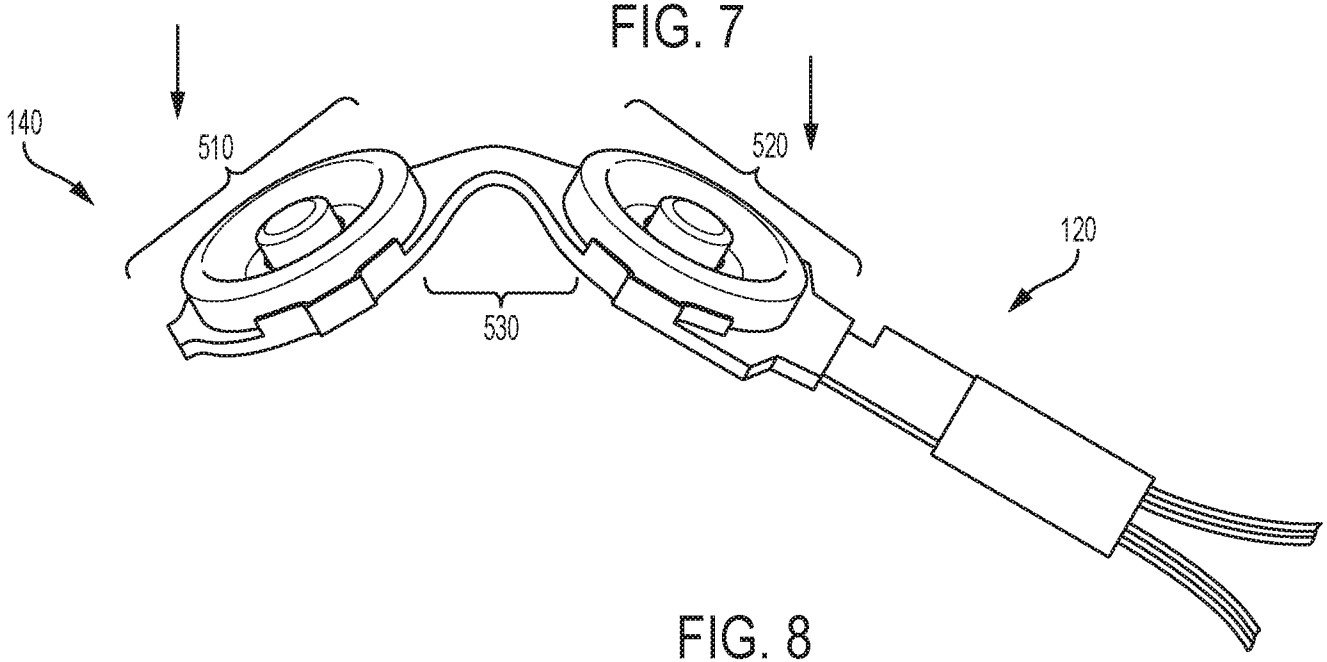
FIG. 8 is a schematic isometric view of an embodiment of a control device being bent.

In addition, as shown in FIG. 8, button module 120 can be substantially deformed along bridge portion 530 itself. In some embodiments, first portion 510 and second portion 520 may also be bent toward one another along narrow bridge portion 530, similar to a folding crease, or bent or flexed backwards in a reverse direction. Thus, the shape of button module 120 provides improved flexibility, resilience, and durability to button module 120. This can be of great use in articles of apparel and footwear, where a user's natural movements can exert different kinds of forces and pressures on button module 120.

As described above with respect to FIG. 1, in different embodiments, article 100 may include aspects, portions, and/or components traditionally included in an article of footwear, such as upper 102 or sole structure 104. In the present disclosure, other non-traditional aspects, portions and/or components may also be included during the manufacture of article 100. In some embodiments, such non-traditional features may include one or more compartments disposed throughout various portions of article 100. For purposes of this disclosure, a compartment refers to a separate or distinct section or portion of article 100. In some embodiments, a compartment can include a sleeve-like region, a tunnel or tubing disposed within article 100, and/or a recess, cavity, pocket, chamber, slot, pouch, or other space configured to receive an object, element, or component. In some embodiments, during manufacture of article 100, one or more compartments can be included in article 100, as will be discussed below.

Figure 9:
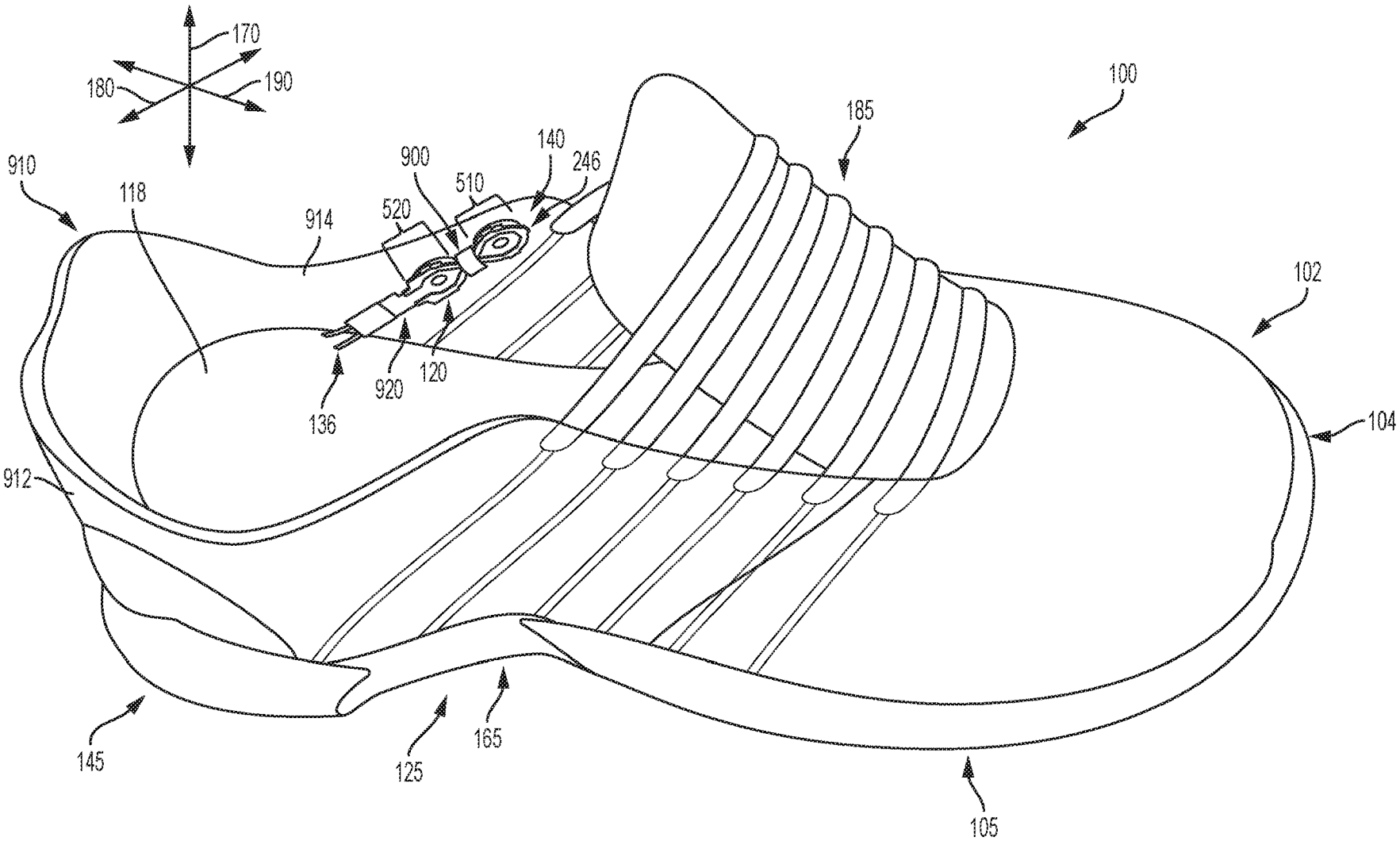
FIG. 9 is an isometric view of an embodiment of a control device installed in an article of footwear.

Referring to FIG. 9, a portion of article 100 is depicted, providing the reader with a view of interior void 118 within upper 102. In one embodiment, a compartment may be formed between two or more layers of upper 102. In other embodiments, the compartment can be formed adjacent to an outer layer 910 of upper 102 and a bootie can be arranged to sandwich the compartment within interior void 118.

As shown in FIG. 9, in some embodiments, upper 102 may include two sides, where each side represents generally opposing sides of upper 102. For example, there may be an outer surface 912 of outer layer 910 of upper 102, where outer surface 912 is the distal surface of outer layer 910, forming at least a portion of the external (outward facing) surface of upper 102. Furthermore, there may be an inner surface 914 of outer layer 910 of upper 102, where inner surface 914 is the proximal surface of outer layer 910 that can face toward a foot when a foot is disposed within interior void 118. It should be understood that there may be one or more layers of additional material disposed between outer layer 910 and interior void 118 in different embodiments.

In some embodiments, there may be one or more components associated with article 100 that are configured to work with and/or provide various functions or features to article 100. As noted above, article 100 may be manufactured to accommodate one or more components in a manner that allows ready and secure incorporation of components post manufacture through inclusion of a compartment. For example, in FIG. 9, located within interior void 118 adjacent to a proximally facing side of outer layer 910 of upper 102, article 100 can include a sleeve 900 that is configured to receive specific components. While sleeve 900 is formed along lateral side 185 in FIG. 9, it should be understood that in other embodiments, sleeve 900 may be disposed along either medial side 165 or lateral side 185 of upper 102. Furthermore, once installed, control device 140 may be disposed in a manner that extends along either or both medial side 165 and lateral side 185, and can be located in any of forefoot region 105, midfoot region 125, and heel region 145.

It should be understood that in different embodiments, article 100 can include various components, devices, or elements that may be used in conjunction with control device 140. In other words, control device 140 may be configured to operate as a part of a tensioning system, or other system, and/or connect with additional components that are associated with article 100. For example, as noted above, article 100 may include various mechanical or electronic contacts disposed throughout one or more regions of article 100. Thus, in some embodiments, prior to or after insertion of control device 140 in sleeve 900, control device 140 may be joined or attached or otherwise linked to connecting elements. In some cases, wiring portion 136 may form a connection with one or more connecting elements in article 100. Furthermore, in some embodiments, portions of control device 140 such as wiring portion 136 can be covered or hidden by other layers of article 100 or compartments formed in upper 102. However, it should be understood that installation or assembly of control device 140 may also occur without any prior connection or later connection to an element of article 100.

In different embodiments, sleeve 900 can comprise a band, loop, tunnel, aperture, compartment, channel, or other type of receiving chamber. In the embodiment of FIG. 9, sleeve 900 comprises a looped band of substantially elastic material. Sleeve 900 can be configured to surround bridge portion 530 (see FIG. 5) and secure button module 120 within article 100.

For example, in some embodiments, first board end 246 of button module 120 can be inserted or slid into sleeve 900, while sleeve 900 is stretched and elastically deformed to a size large enough to accommodate the size of first portion 510. Button module 120 can then be moved further through the loop comprising sleeve 900 until sleeve 900 is disposed over bridge portion 530. As noted above, in some embodiments, the bridge portion can have a smaller width relative to first portion 510. Thus, once sleeve 900 is arranged over or around the bridge portion, sleeve 900 can elastically return to a smaller size, toward its neutral position. In some embodiments, the dimensions of sleeve 900 in its rest position may be selected to be smaller than that of bridge portion 530. In other words, the size of sleeve 900 can be selected such that it is secured tightly or snugly around bridge portion 530 in some embodiments. Furthermore, because of the substantially hourglass shape of button module 120, where the width of the bridge portion is less than the width of either first portion 510 or second portion 520, sleeve 900 can remain in place between first portion 510 and second portion 520.

It can be seen that a lower surface 920 of button module 120 is disposed facing interior void 118, and is more proximal relative to the upper surface comprising the buttons (not shown in FIG. 9), which face toward inner surface 914 of outer layer 910 of upper 102. In some embodiments, sleeve 900 can be configured to position and secure button module 120 in a location corresponding to the desired placement of the buttons in article 100.

Figure 10:
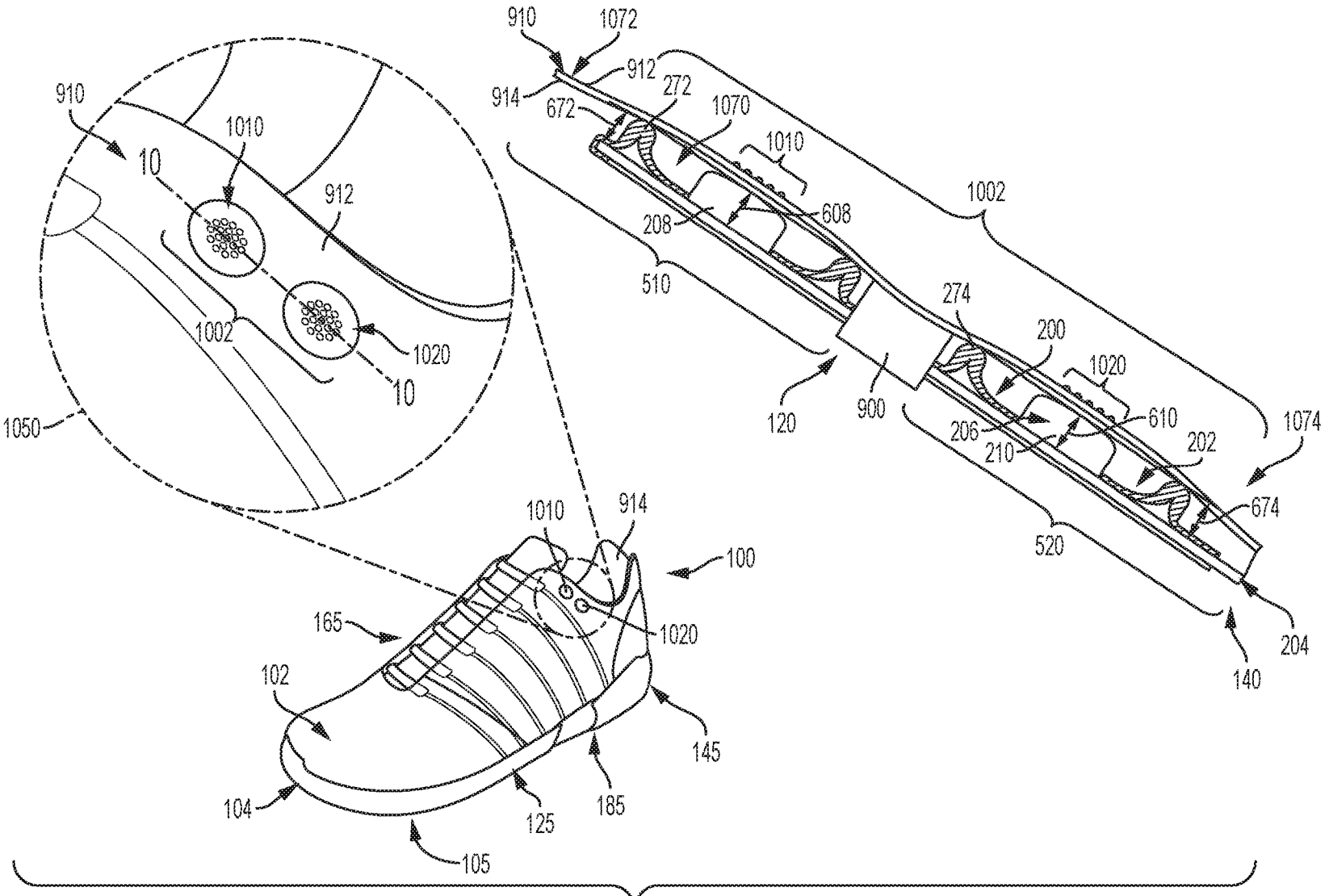
FIG. 10 is an isometric view of an embodiment of a control device installed in an article of footwear with a cross-sectional view of an upper extending over the control device.

For example, referring to FIG. 10, an isometric view of outer layer 910 of upper 102 is shown in article 100. In a magnified view 1050, it can be seen that outer surface 912 of outer layer 910 includes a button region 1002, comprising a first button portion 1010 and a second button portion 1020. In some embodiments, first button portion 1010 and second button portion 1020 can be formed and arranged in outer layer 910 to correspond and align with the placement of the buttons on the button module that has been inserted into the sleeve (see FIG. 9).

A cross-sectional view taken along the line 10-10 is also depicted, representing the incorporation of button module 120 beneath outer layer 910, adjacent to inner surface 914. Standoff assembly 202 is attached to circuit board 204, with annular ridges 200 circumferentially surrounding each of buttons 206. The bridge portion extends between first portion 510 and second portion 520, and is substantially surrounded by sleeve 900. As described above with respect to FIG. 6, it can be seen that in some embodiments, the heights of various portions of standoff assembly 202—in particular annular ridges 200—can be substantially similar. In FIG. 10, as identified earlier, first ridge 272 has first ridge height 672 and second ridge 274 has second ridge height 674. In addition, first button 208 has first button height 608, and second button 210 has second button height 610. In addition, in FIG. 10, first button height 608 is substantially similar to first ridge height 672, and second button height 610 is substantially similar to second ridge height 674. However, it should be understood that in other embodiments, first button height 608 can be slightly smaller or substantially smaller than first ridge height 672, and/or second button height 610 can be slightly smaller or substantially smaller to second ridge height 674

In addition, a portion of outer layer 910 of upper 102 extends a top or distal surface 1070 of button module 120. Button region 1002 of outer layer 910 extends above distal surface 1070 from a first end 1072 of button module 120 to a second end 1074 of button module 120. It can be seen that button region 1002 stretches along or over distal surface 1070 of button module 120, from the concentric ring comprising first ridge 272 to the concentric ring comprising second ridge 274. In different embodiments, along outer surface 912 of first button portion 1010 and/or outer surface 912 of second button portion 1020, there may be additional texturing, nubs, or other texture elements attached to the surface. In some embodiments, the outer surfaces of the button portions of upper 102 can include three-dimensional printed material that can help indicate to a user the location of each corresponding button that is disposed beneath upper 102. Thus, in some cases, first button 208 can each be positioned directly underneath first button portion 1010, and second button 210 can be positioned directly underneath second button portion 1020, and may readily be located by a user.

Figure 11:
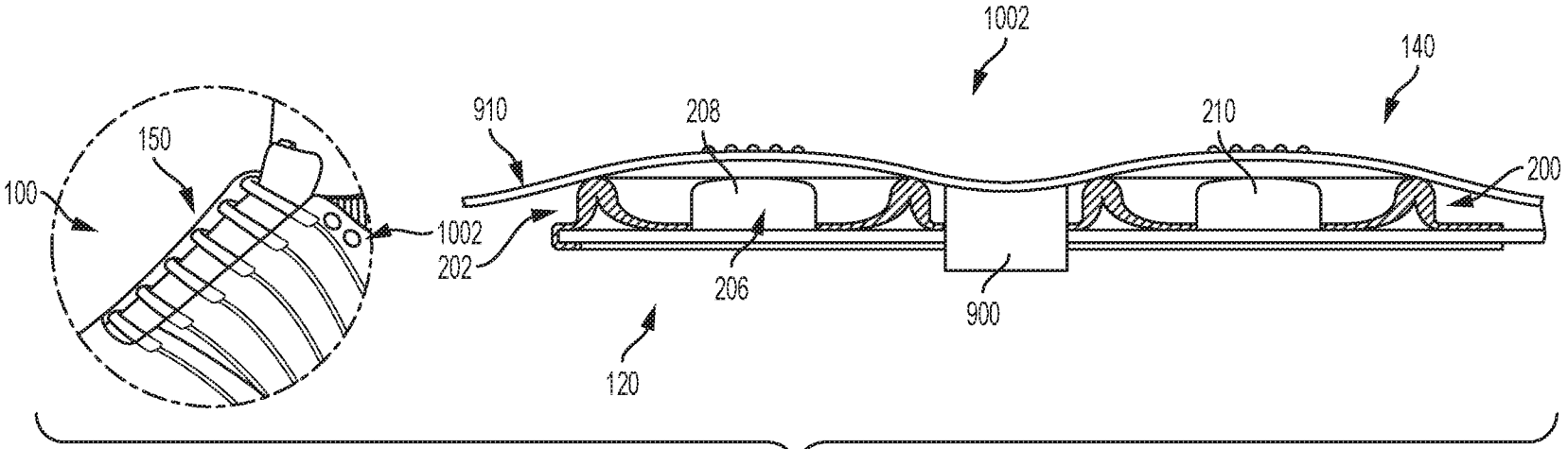
FIG. 11 is a schematic isometric side view of an embodiment of an article of footwear with a cross-sectional view of a control device in a loosened state.
Figure 12:
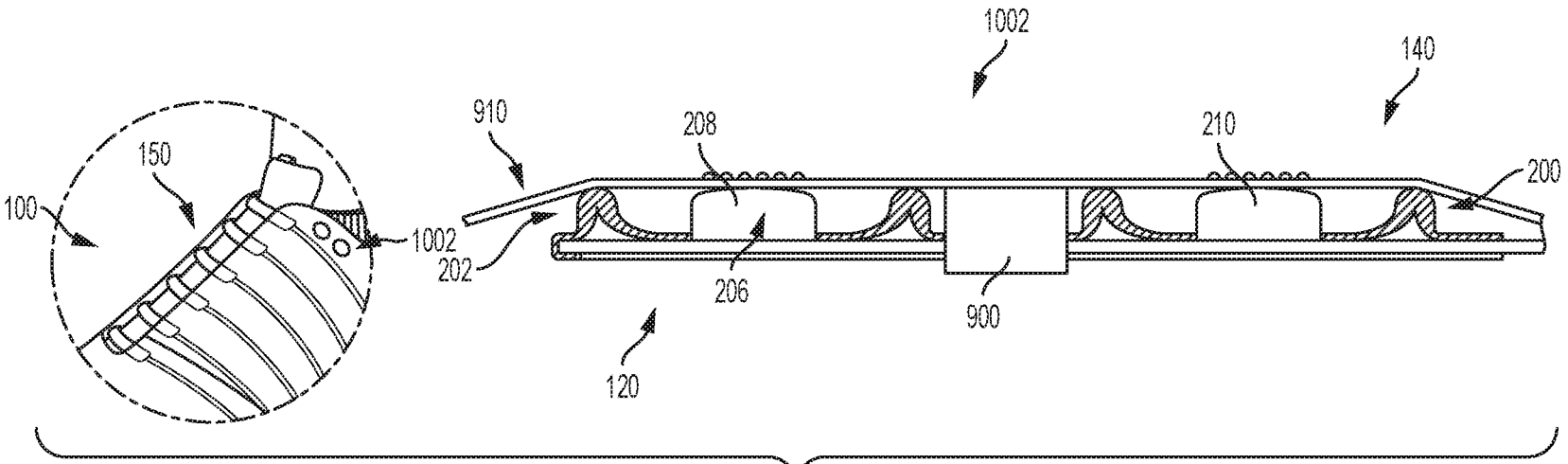
FIG. 12 is a schematic isometric side view of an embodiment of an article of footwear with a cross-sectional view of a control device in a tensioned state.

In FIGS. 11 and 12, one embodiment of the application of standoff assembly 202 in button module 120 as incorporated in article 100 is shown. FIG. 11 provides a representation of article 100 in a loosened state, and FIG. 12 provides a representation of article 100 in a tensioned state. In FIG. 11, button region 1002 of outer layer 910 extends loosely over button module 120. However, once tensioning system 150 of article 100 is activated, and the tension of article 100 increases toward the tensioned state of FIG. 12, it can be seen that in some embodiments, outer layer 910 can become stretched and increasingly taut. As noted above, in some embodiments, the two concentric raised rings of standoff assembly 202 have a height level with (or greater than) the tops of each of the buttons, and each of the rings are configured to surround buttons 206 while permitting access to the button. Thus, in some embodiments, when upper 102 is tightened and the force exerted by button region 1002 over button module 120 increases, the fabric of upper 102 is raised and stretched taut over the top of each of the ridges of standoff assembly 202. In other words, standoff assembly 202 can help to relieve inadvertent force or pressure from the fabric against the buttons. In some embodiments, when button region 1002 of upper 102 is stretched to a greater degree in the tensioned state relative to the loosened state, button region 1002 exerts a substantially similar force on first button 208 in the tensioned state as in the loosened state. Similarly, in some embodiments, when button region 1002 of upper 102 is stretched to a greater degree in the tensioned state relative to the loosened state, button region 1002 exerts a substantially similar force on second button 210 in the tensioned state as in the loosened state.

In one embodiment, standoff assembly 202 can provide a framework that engages outer layer 910 such that, when tensioned, outer layer 910 can mimic a kind of "trampoline" material across the annular ridges. In some embodiments, this structure can minimize the risk of accidental depression of the button that is positioned at the center of the annular ridges. In one embodiment, this can decrease the chance of inadvertent contact with the buttons that can cause an auto-lacing system in article 100 to be activated.

In addition, in some other embodiments, a stiffener can be disposed along the backside of button module 120 or control device 140 that outlines the hourglass shape described herein. The stiffener can provide additional resistance to force applied to button module 120 during button presses and use of control device 140.

Figure 13:
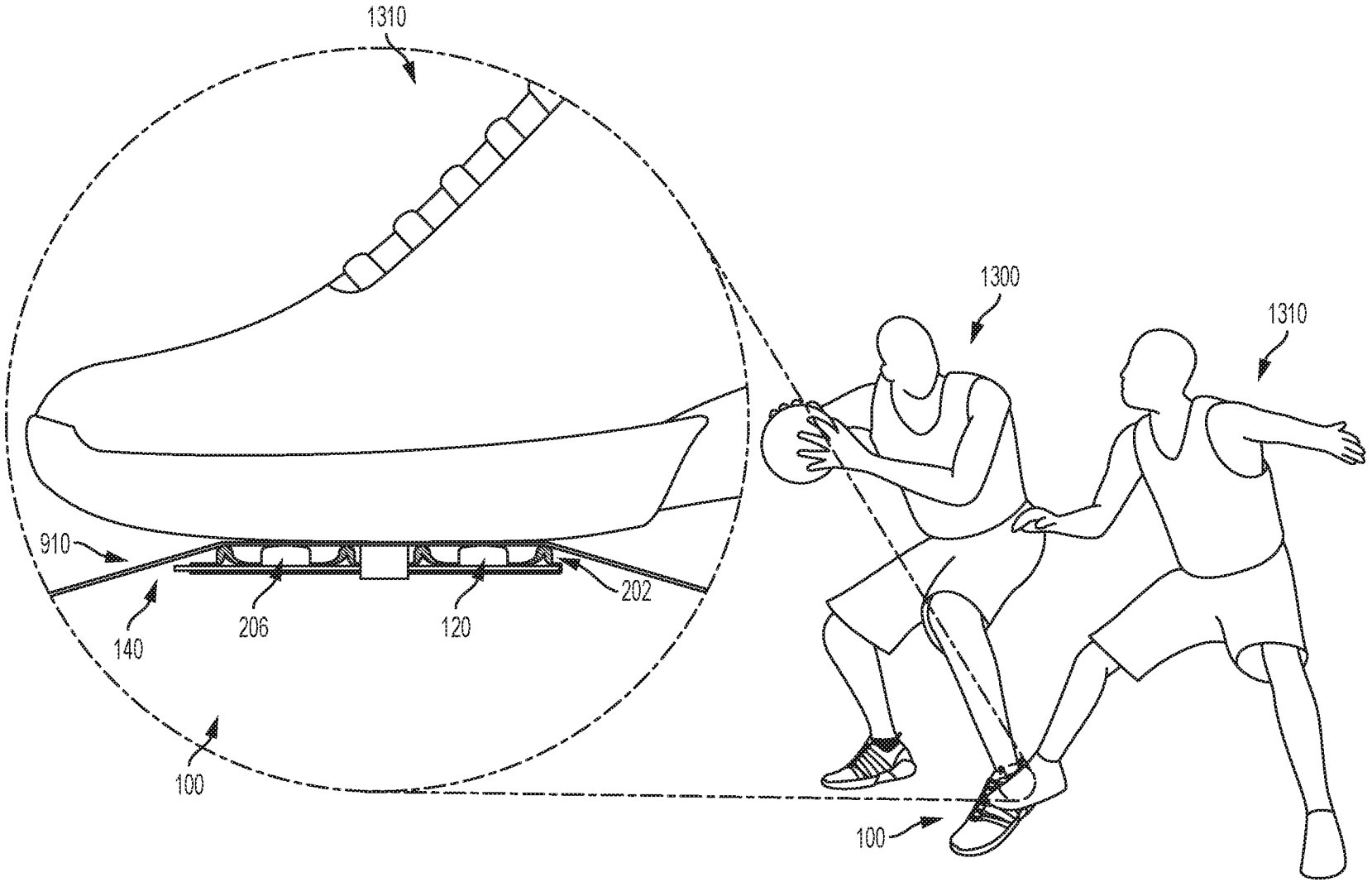
FIG. 13 is a depiction of a user engaged in an activity, where the user is wearing an article of footwear that includes a control device.

In addition, in some embodiments, this structural arrangement can help prevent accidental depression of each of buttons 206 during use of article 100 in different environments. FIG. 13 illustrates one example, in which a user 1300 wearing article 100 is engaged in athletic activity with a first player 1310. As user 1300 moves on the court, first player 1310 can physically engage or contact user 1300. In one embodiment, first player 1310 may exert a force against button region 1002 of article 100. In some embodiments, due to the inclusion of standoff assembly 202, buttons 206 can be protected from inadvertent depression. In other words, the configuration of standoff assembly 202 along button module 120 can decrease the possibility of activation of the auto-lacing system that might otherwise occur from jostling or contact during play in different embodiments.

In different embodiments, any of the components described herein could be disposed in any other portions of an article, including various regions of the upper and/or sole structure. In some cases, some component parts (such as the wiring portion, etc.) could be disposed in one portion of an article and other component parts (such as the button module, etc.) could be disposed in another, different, portion. The location of one or more component parts may be selected according to various factors including, but not limited to, size constraints, manufacturing constraints, aesthetic preferences, optimal design and functional placement, ease of removability or accessibility relative to other portions of the article, as well as possibly other factors.

It should be understood that the embodiments and features described herein are not limited to a particular user interface or application for operating a motorized tensioning device or a tensioning system. Furthermore, the embodiments here are intended to be exemplary, and other embodiments could incorporate any additional control buttons, interface designs and software applications. The control buttons for initiating various operating commands can be selected according to various factors, including ease of use, aesthetic preferences of the designer, software design costs, operating properties of the system, as well as possibly other factors. Furthermore, a variety of products, including apparel (e.g., shirts, pants, footwear), may incorporate an embodiment of the control device described herein, as well as other types of articles, such as bed coverings, table coverings, towels, flags, tents, sails, and parachutes, or articles with industrial purposes that include automotive and aerospace applications, filter materials, medical textiles, geotextiles, agrotextiles, and industrial apparel.

Figure 14:
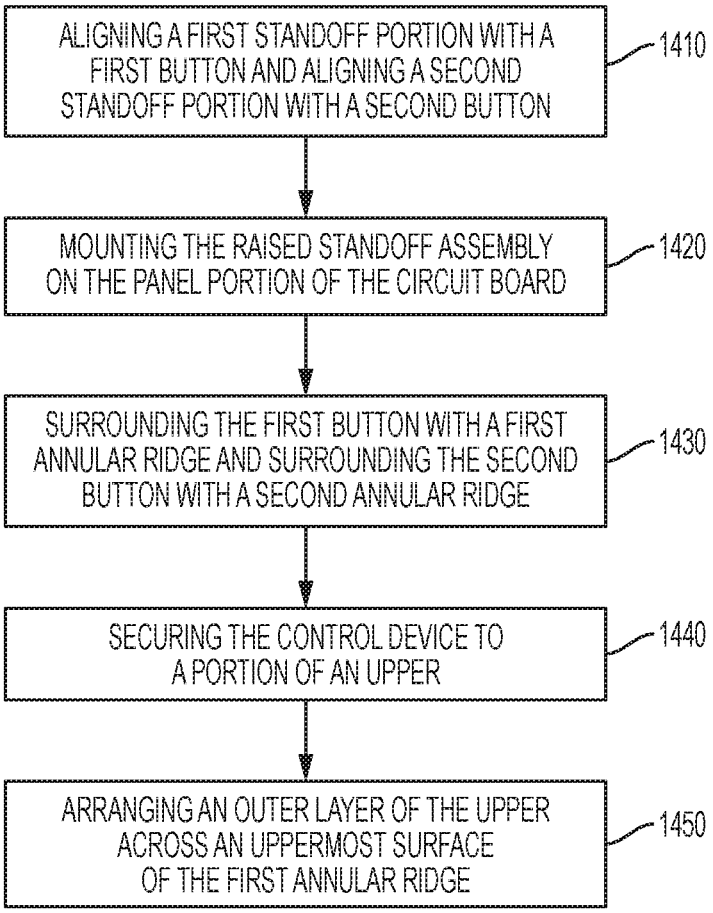
FIG. 14 is a flow chart depicting a method of assembling an article of footwear with a control device.

It should be understood that the control devices depicted herein can be installed in different ways. For purposes of illustration, FIG. 14 provides a flow chart depicting one method of installing a control device in an article of footwear or an article of apparel. In one embodiment, the method of assembly of the article of footwear with the control device—the control device having a raised standoff assembly and a circuit board, and the circuit board including a panel portion, the panel portion including a first button and a second button—can include a first step 1410 of aligning a first standoff portion of the raised standoff assembly with the first button of the panel portion and aligning a second standoff portion of the raised standoff assembly with the second button of the panel portion. In some embodiments, a second step 1420 comprises stretching an outer border of the raised standoff assembly to surround and capture an outer edge of the panel portion, thereby mounting the raised standoff assembly on the panel portion of the circuit board. A third step 1430 can include circumferentially surrounding the first button with a first annular ridge of the first standoff portion and circumferentially surrounding the second button with a second annular ridge of the second standoff portion, where the first button and the first annular ridge have a substantially similar height. In a fourth step 1440, the control device can be secured to a portion of an upper of the article of footwear, and in a fifth step 1450, an outer layer of the upper can be arranged across an uppermost surface of the first annular ridge such that the outer layer extends over the first button, thereby inhibiting the outer layer of the upper from exerting pressure against the first button.

In other embodiments, the method can further include attaching a stiffener to a lower surface of the button module. Another step can comprise inserting the control device into a sleeve that is attached to the outer layer of the upper, as discussed above with respect to FIG. 9. In addition, in some embodiments, the method can comprise printing texture elements on a button region of the outer layer, where the button region is disposed above the first button and the second button, as discussed above with respect to FIG. 10. Furthermore, the method can include connecting a wiring portion of the control device to an auto-lacing system in the article of footwear.

While various embodiments have been described, the description is intended to be exemplary, rather than limiting, and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

What is claimed is:

1. An article of footwear, the article of footwear comprising:

an upper and a sole attached to the upper, the upper and sole forming an interior void and including an inner layer and an outer layer;

a control device including a button module, the button module comprising a circuit board, a raised standoff assembly, a first portion, a second portion, and a bridge portion extending between the first portion and the second portion, wherein the bridge portion has a bridge width that is smaller than a width of the first portion;

the circuit board including a panel portion;

a first button mounted on the panel portion of the circuit board and a second button also mounted on the panel portion of the circuit board;

the raised standoff assembly secured on the panel portion of the circuit board;

the raised standoff assembly comprising a first standoff portion and a second standoff portion, wherein the first standoff portion is joined to the second standoff portion by an intermediate standoff portion having a width smaller than a width of the first standoff portion and smaller than a width of the second standoff portion;

the first standoff portion including a first annular ridge that surrounds the first button the first standoff portion configured to attach to the first portion of the button module, the second standoff portion including a second annular ridge that surrounds the second button, the second standoff portion configured to attach to the second portion of the button module;

the first annular ridge having a first ridge height around a complete perimeter of the first button that is at least as high as a first button height of the first button or higher; and the button module being disposed between the inner layer and the outer layer of the upper, at least a portion of the first button is covered by a continuous portion of the outer layer of the upper and being adjacent to an inner surface of the outer layer of the upper within the interior void of the article of footwear, wherein the first annular ridge inhibits the inner surface from depressing the first button.

2. The article of footwear according to claim 1, wherein the second annular ridge has a second ridge height that is at least as high as a second button height of the second button.

3. The article of footwear according to claim 1, wherein the control device further comprises a wiring portion joined to the button module.

4. The article of footwear according to claim 1, wherein wherein the bridge width is also smaller than a second width of the second portion, wherein the bridge portion enables the first portion to move relative to the second portion.

5. The article of footwear according to claim 4, wherein a sleeve comprising an elastic band is attached to an inner surface of the upper, and wherein the sleeve is configured to receive and secure the button module in the interior void of the article of footwear.

6. The article of footwear according to claim 5, wherein the bridge portion is enclosed in the sleeve when the button module is installed in the article of footwear.

7. The article of footwear according to claim 1, wherein the button module is disposed adjacent to and beneath a button region of the upper, and wherein the button region is configured to extend over the button module from a first end of the button module to a second end of the button module.

8. The article of footwear according to claim 7, wherein the article of footwear further comprises a tensioned state and a loosened state, wherein the button region of the upper is stretched to a greater degree in the tensioned state relative to the loosened state, and wherein the button region exerts a substantially similar force on the first button in the tensioned state as in the loosened state.

9. An article of footwear with a control system, the article of footwear comprising:

an upper and a sole structure, the upper including an inner layer and an outer layer, the upper and sole forming an interior void;

a button module, the button module comprising a circuit board, the circuit board including a panel portion;

the button module comprising a first portion and a second portion, wherein the first portion is joined to the second portion by a bridge portion;

the button module being disposed between the inner layer and the outer layer of the upper, at least a portion of the button module being covered by the outer layer of the upper and adjacent to an inner surface of the outer layer;

a first button mounted on the panel portion of the circuit board and a second button also mounted on the panel portion of the circuit board;

a raised standoff assembly secured to the panel portion of the circuit board;

the raised standoff assembly comprising a first standoff portion and a second standoff portion, wherein the first standoff portion is joined to the second standoff portion by an intermediate standoff portion having a width smaller than a width of the first standoff portion and smaller than a width of the second standoff portion, the intermediate standoff portion permitting the first standoff portion to move relative to the second standoff portion; and the first standoff portion including a first annular ridge that surrounds the first button the first standoff portion configured to attach to the first portion of the button module, the second standoff portion including a second annular ridge that surrounds the second button, the second standoff portion configured to attach to the second portion of the button module, the first annular ridge having a first ridge height around a complete perimeter of the first button that is at least as high as a first button height of the first button or higher, wherein the first annular ridge inhibits the outer layer from depressing the first button;

the bridge portion of the button module having a bridge width that is less than a first width of the first portion; and wherein the bridge portion permits the first portion to move relative to the second portion.

10. The article of footwear according to claim 9, wherein the bridge width is also less than a second width of the second portion.

11. The article of footwear according to claim 9, wherein the raised standoff assembly further includes a lip portion extending along a peripheral edge of the raised standoff assembly, and wherein the lip portion surrounds an outer edge of the panel portion.

12. The article of footwear according to claim 9, wherein the first portion is configured to torsionally twist relative to the second portion due to the bridge portion.

* * * * *